US009324214B2

(12) United States Patent
Aoki et al.

(10) Patent No.: US 9,324,214 B2
(45) Date of Patent: Apr. 26, 2016

(54) WAGERING GAME HAVING ENHANCED DISPLAY OF WINNING SYMBOLS

(71) Applicant: WMS Gaming Inc., Waukegan, IL (US)

(72) Inventors: Dion K. Aoki, Chicago, IL (US); Allon G. Englman, Chicago, IL (US); Joel R. Jaffe, Glenview, IL (US)

(73) Assignee: BALLY GAMING, INC., Las Vegas, NV (US)

( * ) Notice: Subject to any disclaimer, the term of this patent is extended or adjusted under 35 U.S.C. 154(b) by 64 days.

(21) Appl. No.: 13/783,566

(22) Filed: Mar. 4, 2013

(65) Prior Publication Data

US 2014/0066170 A1 Mar. 6, 2014

Related U.S. Application Data

(60) Provisional application No. 61/697,119, filed on Sep. 5, 2012.

(51) Int. Cl.
*G07F 17/34* (2006.01)
*G07F 17/32* (2006.01)

(52) U.S. Cl.
CPC ..... *G07F 17/34* (2013.01); *G07F 17/3211* (2013.01)

(58) Field of Classification Search
None
See application file for complete search history.

(56) References Cited

U.S. PATENT DOCUMENTS 6,251,013 B1 6/2001 Bennett
6,311,976 B1 11/2001 Yoseloff et al.
6,347,996 B1 2/2002 Gilmore et al.
6,517,433 B2 2/2003 Loose et al.
6,755,737 B2 6/2004 Jackson et al.
6,866,585 B2 3/2005 Muir
6,887,157 B2 5/2005 LeMay et al.
7,335,101 B1 * 2/2008 Luciano, Jr. ..... 463/16
7,828,656 B2 11/2010 Paulsen et al.
8,182,333 B2 5/2012 Pacey
8,187,103 B2 5/2012 Paulsen et al.
8,562,425 B2 10/2013 Englman et al.
8,608,544 B2 12/2013 Aoki et al.
2003/0032479 A1 2/2003 LeMay et al.
2003/0064781 A1 * 4/2003 Muir ..... 463/20
2003/0064800 A1 4/2003 Jackson et al.
2003/0092487 A1 * 5/2003 Meyer ..... 463/30
2004/0053686 A1 3/2004 Pacey et al.
2004/0077401 A1 * 4/2004 Schlottmann ..... 463/20
2004/0102244 A1 5/2004 Kryuchkov et al.

(Continued)

FOREIGN PATENT DOCUMENTS

WO WO 2004/002591 A2 1/2004
WO WO 2004/028650 A1 4/2004

(Continued)

*Primary Examiner* — Jason Skaarup
(74) *Attorney, Agent, or Firm* — Nixon Peabody LLP

(57) ABSTRACT

An outcome of a wagering game is evaluated to determine if it is a winning outcome. In response to the outcome being a winning outcome, it is determined if the winning outcome includes two or more groups of winning symbols. In response to determining that the winning outcome includes two or more groups of winning symbols, each of the two or more groups of winning symbols is visually highlight in a sequential fashion. Further, it is determined if each of the two or more groups includes winning symbols on two or more lines. In response to determining that one of the two or more groups includes winning symbols on two or more lines, the winning symbols on each of the two or more lines is visually highlighted in a sequential fashion.

34 Claims, 12 Drawing Sheets

(56) References Cited

U.S. PATENT DOCUMENTS

| | | | | |
|---|---|---|---|---|
| 2004/0102245 | A1 | 5/2004 | Escalera et al. | |
| 2004/0192430 | A1 | 9/2004 | Burak et al. | |
| 2004/0192431 | A1* | 9/2004 | Singer et al. | 463/20 |
| 2004/0198485 | A1* | 10/2004 | Loose et al. | 463/20 |
| 2004/0219968 | A1 | 11/2004 | Fiden et al. | |
| 2004/0219969 | A1 | 11/2004 | Casey et al. | |
| 2004/0259627 | A1* | 12/2004 | Walker | G07F 17/3211 463/20 |
| 2004/0266536 | A1 | 12/2004 | Mattice et al. | |
| 2005/0037843 | A1 | 2/2005 | Wells et al. | |
| 2005/0059487 | A1 | 3/2005 | Wilder et al. | |
| 2005/0075167 | A1 | 4/2005 | Beaulieu et al. | |
| 2005/0215319 | A1 | 9/2005 | Rigopulos et al. | |
| 2005/0255908 | A1 | 11/2005 | Wells | |
| 2006/0052152 | A1 | 3/2006 | Tedsen et al. | |
| 2006/0287104 | A1* | 12/2006 | White et al. | 463/42 |
| 2007/0060245 | A1* | 3/2007 | Veenker | G07F 17/32 463/16 |
| 2008/0188303 | A1 | 8/2008 | Schlottmann et al. | |
| 2008/0220839 | A1* | 9/2008 | DeBrabander et al. | 463/16 |
| 2009/0131145 | A1* | 5/2009 | Aoki et al. | 463/20 |
| 2009/0291742 | A1 | 11/2009 | Sines et al. | |
| 2010/0062196 | A1 | 3/2010 | Bezek et al. | |
| 2010/0234094 | A1 | 9/2010 | Gagner et al. | |
| 2010/0234099 | A1 | 9/2010 | Rasmussen et al. | |
| 2011/0021266 | A1* | 1/2011 | Jaffe et al. | 463/25 |
| 2012/0202581 | A1* | 8/2012 | Bennett et al. | 463/20 |
| 2012/0238338 | A1 | 9/2012 | Kuhn et al. | |
| 2013/0116032 | A1 | 5/2013 | Lutnick | |
| 2013/0165205 | A1 | 6/2013 | Collette et al. | |
| 2013/0252699 | A1* | 9/2013 | Nauman et al. | 463/20 |

FOREIGN PATENT DOCUMENTS

| | | | |
|---|---|---|---|
| WO | WO 2004/029893 | A1 | 4/2004 |
| WO | WO 2006/039257 | A1 | 4/2006 |
| WO | WO 2006/039348 | A1 | 4/2006 |
| WO | WO 2006/039371 | A2 | 4/2006 |
| WO | WO 2010/056924 | A1 | 5/2010 |

* cited by examiner

WAGERING GAME HAVING ENHANCED DISPLAY OF WINNING SYMBOLS

CROSS-REFERENCE TO RELATED APPLICATION

This application claims the benefit of U.S. Provisional Application No. 61/697,119, filed Sep. 5, 2012, which is hereby incorporated by reference herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to wagering game machines and, more particularly, to wagering game machines having an enhanced display of winning symbols.

BACKGROUND

Gaming machines or terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing terminals and the expectation of winning each terminal is roughly the same (or believed to be the same), players are most likely to be attracted to the more entertaining and exciting terminal. As a result, wagering game machine operators strive to employ the most entertaining and exciting machines available, because such machines attract frequent play and provide increased profitability for the operators.

SUMMARY OF THE INVENTION

A method for conducting a wagering game via a gaming terminal includes receiving, via an input device, an input indicative of a wager to play the wagering game. An array of symbol positions is displayed on one or more display devices. A plurality of symbols is randomly distributed such that each of the symbol positions is associated with one of the symbols, thereby forming an outcome. The outcome is evaluated to determine if the outcome is a winning outcome. In response to the outcome being a winning outcome formed by winning symbols and non-winning symbols, it is determined if the winning outcome includes two or more groups of winning symbols. In response to determining that the winning outcome includes two or more groups of winning symbols, each of the two or more groups of winning symbols is visually highlight in a sequential fashion on the one or more display devices. Further, it is determined if each of the two or more groups includes winning symbols on two or more lines. In response to determining that one of the two or more groups includes winning symbols on two or more lines, the winning symbols on each of the two or more lines is visually highlighted in a sequential fashion on the one or more display devices.

A method for conducting a wagering game via a gaming terminal includes receiving, via an input device, an input indicative of a wager to play the wagering game. A plurality of symbol-bearing reels is displayed on one or more display devices. The reels are visually spun and stopped such that a randomly selected outcome is indicated by the reels. The outcome is determined to be a winning outcome that includes two or more groups of winning symbols. A first group of the two or more groups of winning symbols is visually highlighted in a sequential fashion on the one or more display devices. The first group includes winning symbols on two or more lines. A second group of the two or more groups of winning symbols is then visually highlighted in the sequential fashion on the one or more display devices.

A gaming system includes an input device, one or more display devices, one or more processors, and one or more memory devices. The one or more memory devices store instructions that, when executed by at least one of the one or more processors, cause the gaming system to receive, via the input device, an input indicative of a wager to play a wagering game. The gaming system is further caused to display, on at least one of the one or more display devices, a plurality of symbol-bearing reels and visually spin the reels and stop the reels such that a randomly selected outcome is indicated by the reels. The outcome is evaluated to determine if the outcome is a winning outcome. In response to the outcome being a winning outcome formed by winning symbols and non-winning symbols, each group of winning symbols is visually highlighted in a sequentially fashion. At least one of the groups includes winning symbols on two or more lines.

Additional aspects of the present disclosure will be apparent to those of ordinary skill in the art in view of the detailed description of various implementations, which is made with reference to the drawings, a brief description of which is provided below.

Figure 1:
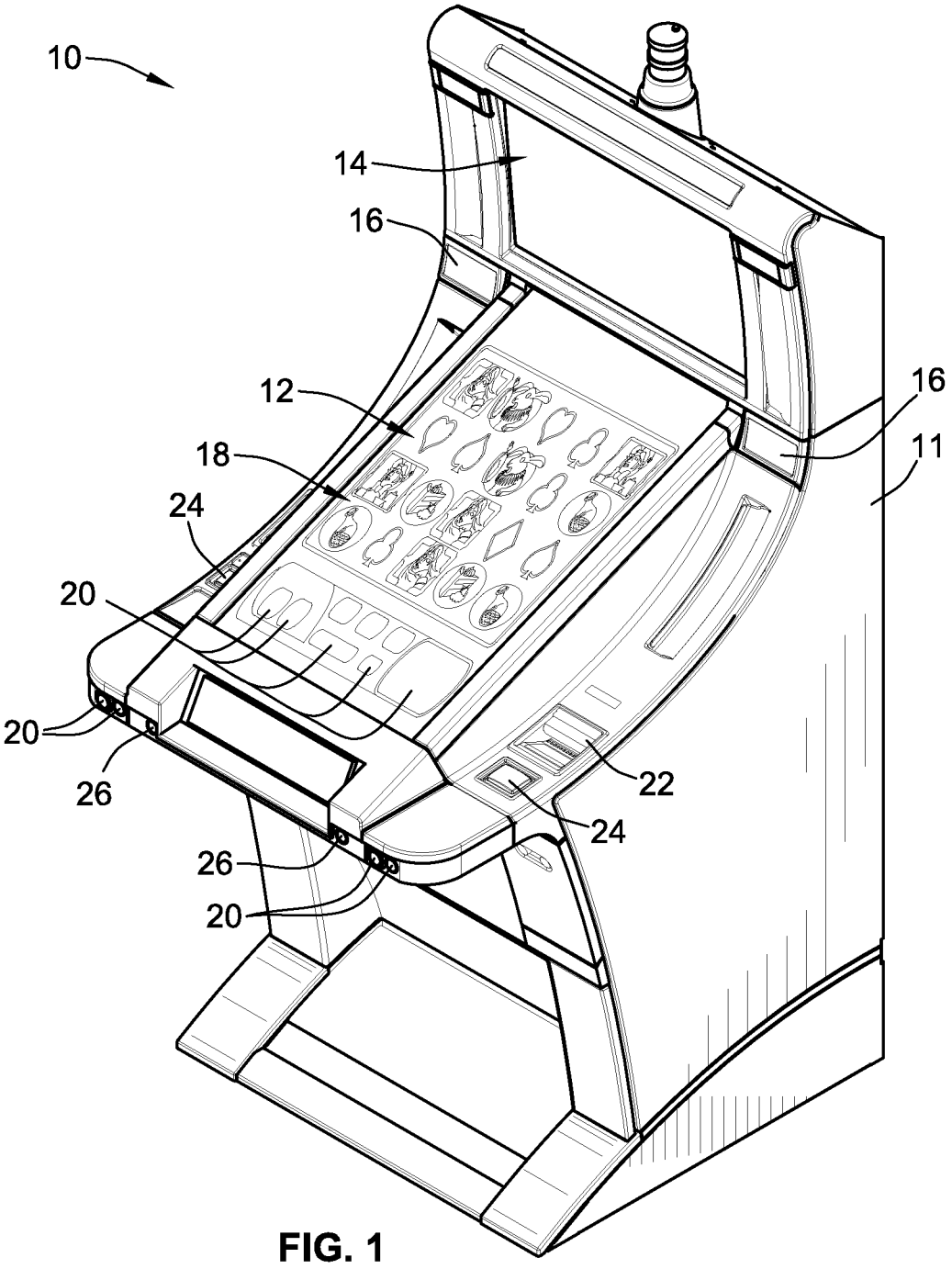
FIG. 1 is a perspective view of a free-standing gaming terminal according to some aspects of the present disclosure.

While the present disclosure is susceptible to various modifications and alternative forms, specific implementations have been shown by way of example in the drawings and will be described in detail herein. It should be understood, however, that the present disclosure is not intended to be limited to the particular forms disclosed. Rather, the disclosure is to cover all modifications, equivalents, and alternatives falling within the spirit and scope of the present invention as defined by the appended claims.

DETAILED DESCRIPTION

While this disclosure is susceptible of embodiment in many different forms, there is shown in the drawings and will herein be described in detail preferred embodiments of the disclosure with the understanding that the present disclosure is to be considered as an exemplification of the principles of the disclosure and is not intended to limit the broad aspect of the disclosure to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

Referring to FIG. 1, there is shown a gaming terminal 10 similar to those used in gaming establishments, such as casinos. With regard to the present disclosure, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication Nos. US2010/0062196 and US2010/0234099, which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
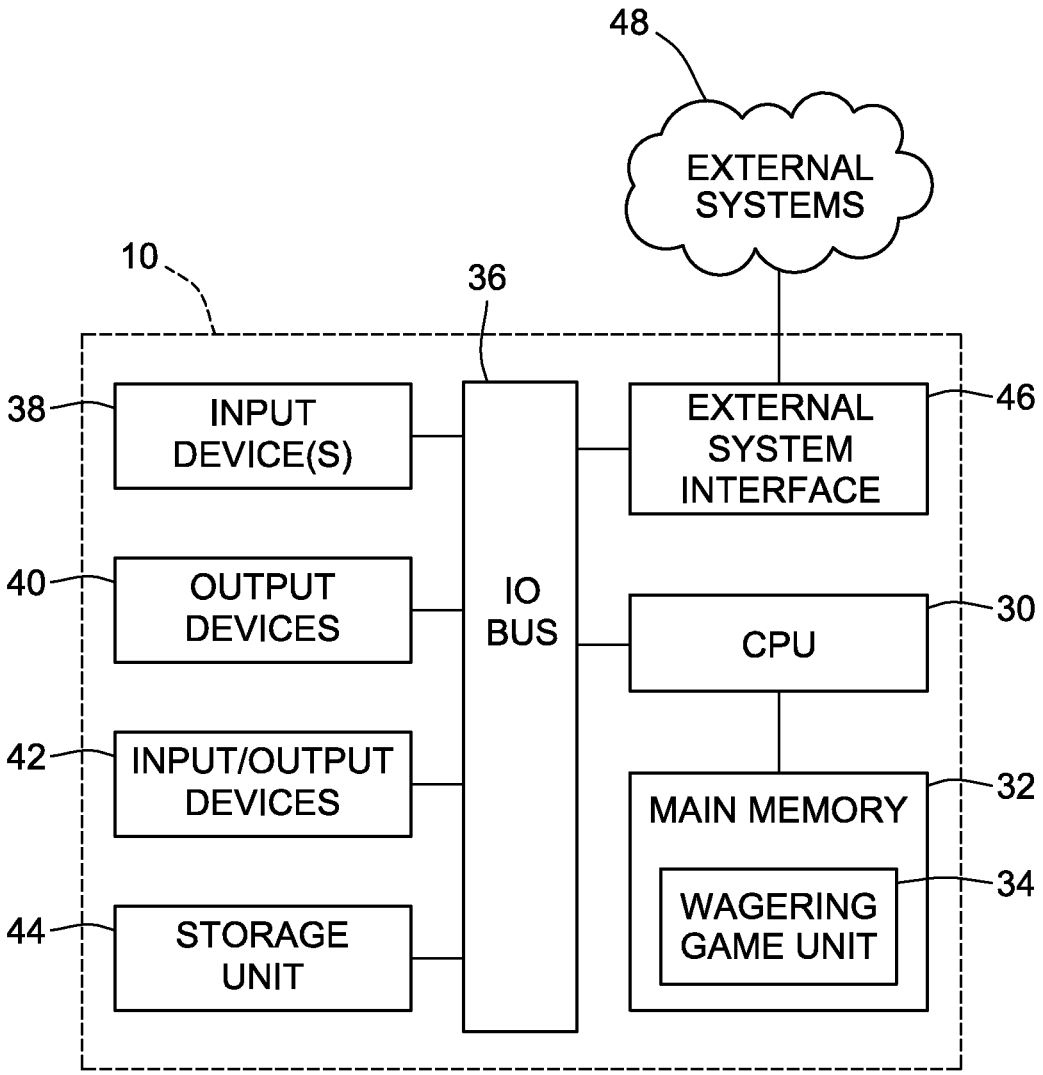
FIG. 2 is a schematic view of a gaming system according to some aspects of the present disclosure.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
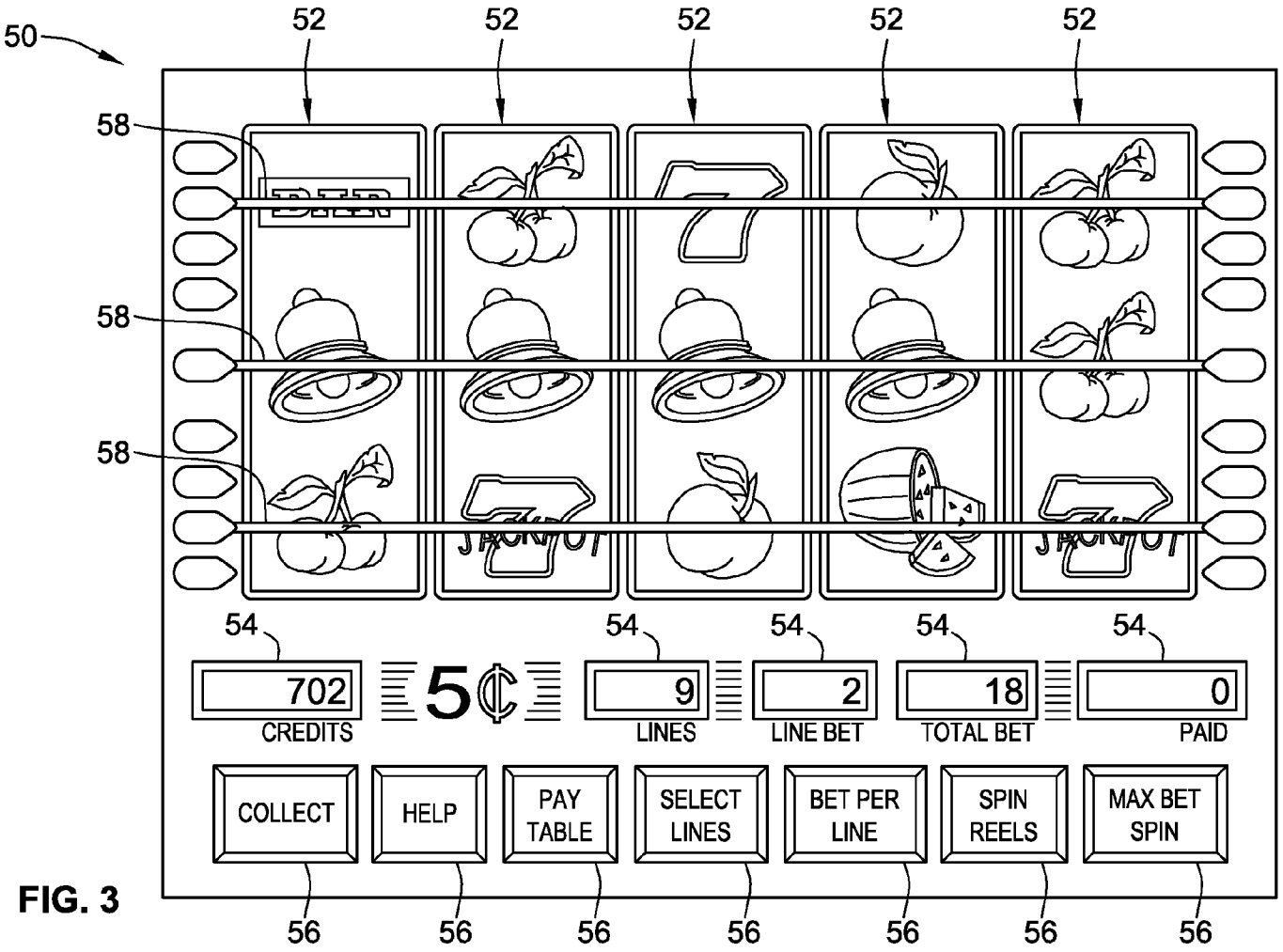
FIG. 3 is an image of an exemplary basic-game screen of a wagering game displayed on a gaming terminal according to some aspects of the present disclosure.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

The primary display area 12 and/or the secondary display area 14 (FIG. 1) can be used for displaying one or more portions of a wagering game. Referring generally to FIGS. 4-12, screen shots 100*a*-100*i* of the primary display area 12 and/or the secondary display area 14 illustrate one play of a wagering game according to some aspects of the disclosed concepts.

Generally, one play or spin of the wagering game provides a random outcome (FIG. 4) that is evaluated to determine if it is a winning outcome. An outcome of the wagering game is a winning outcome if it includes winning symbols. In order for a symbol to be a winning symbol, and thus, contributing to the outcome being a winning outcome, the symbol must be part of one or more combinations of symbols on one or more lines of the wagering game that correspond with one or more respective winning combinations of symbols included in a paytable of the wagering game. The paytable associates each possible winning combination, for the wagering game, with an award (e.g., credits) that is provided to the player of the wagering game once that winning combination is achieved. Thus, a winning outcome can include multiple combinations of symbols that correspond with respective winning combinations of symbols in the paytable. By the term line of the wagering game it is meant to include "paylines" in payline related wagering games and "ways" in any pay or any way related wagering games.

For purposes of the present disclosure, a respective combination of symbols that is in the paytable (e.g., three-of-a-kind heart symbols) and on a line is referred to as winning symbols on a line. Winning symbols on a winning line only include the symbols that cause the line to be a winning line. Symbols on a line of the wagering game that do not contribute to the line being a winning line are non-contributing symbols. It is possible that a symbol is a non-contributing symbol for one winning line, but is a winning symbol for a different winning line. Additionally, a non-contributing symbol can also be a non-winning symbol for all lines. By non-winning symbol, it is meant that the symbol does not contribute to any line being a winning line.

For example, suppose an array of symbol positions includes five columns and three rows, where each line is associated with five symbol positions (other lengths of lines are possible). In such an example, if an outcome is a winning outcome that only includes one three-of-a-kind arrangement of winning symbols (e.g., three hearts on a line), the five symbol positions of the winning line are associated with three winning symbols and two non-contributing symbols. As the three-of-a-kind arrangement of winning symbols includes the only three winning symbols (e.g., the three heart symbols), the two non-contributing symbols, in this example, are non-winning symbols as there are no other winning lines.

Winning symbols on a line is the smallest granularity of a winning outcome. Thus, a winning outcome can include winning symbols on multiple lines of the wagering game. For example, a winning outcome can include winning symbols on two or more lines. If winning symbols on two or more lines are of the same kind or type of symbol (e.g., all winning symbols on the lines are heart symbols), the winning symbols on the lines of the same kind form a group of winning symbols of the same kind. However, winning symbols on a single line can also be referred to as a group of winning symbols that only includes the winning symbols on the one line.

Similarly, the winning outcome can include multiple groups of winning symbols. For example, a winning outcome can include winning heart symbols on one line and winning spade symbols on two lines. The winning heart symbols on the one line forms a first group of winning symbols and the winning spade symbols on the two lines form a second group of winning symbols.

With the above understanding of winning outcomes, winning symbols, non-winning symbols, non-contributing symbols, winning symbols on lines, and groups of winning symbols, a general overview of some of the concepts disclosed herein is provided. Generally, one play or spin of the wagering game provides a random outcome that is evaluated (FIG. 4) to determine if it is a winning outcome. If the outcome is a winning outcome, then the winning outcome is evaluated to determine if the winning outcome includes two or more groups of winning symbols. If the winning outcome includes two or more groups of winning symbols, then each of the groups is evaluated to determine if the group includes winning symbols on two or more lines. In the illustrated example of FIGS. 4-12, the outcome (FIG. 4) is a winning outcome that includes two groups of winning symbols, where a first one of the groups includes winning symbols on one line and a second one of the groups includes winning symbols on four lines. In such an example, the winning symbols are visually highlighted according to some of the present concepts in the following sequential order: (a) all of the winning symbols (FIG. 5), (b) the first group of winning symbols (FIG. 6), (c) the second group of winning symbols (FIG. 7), (d) the winning symbols of the only line included in the first group (FIG. 8), (e) the winning symbols on a first one of the lines included in the second group (FIG. 9), (f) the winning symbols on a second one of the lines included in the second group (FIG. 10), (g) the winning symbols on a third one of the lines included in the second group (FIG. 11), and (h) the winning symbols on a fourth one of the lines included in the second group (FIG. 12). Various alternative orders and combinations of visually displaying the groups and/or lines of winning symbols are contemplated. For example, in some implementations, only steps (b) and (c) are included in the sequential visually highlighting. For another example, in some implementations, only steps (b) through (h) are included in the sequential visually highlighting.

Figure 4:
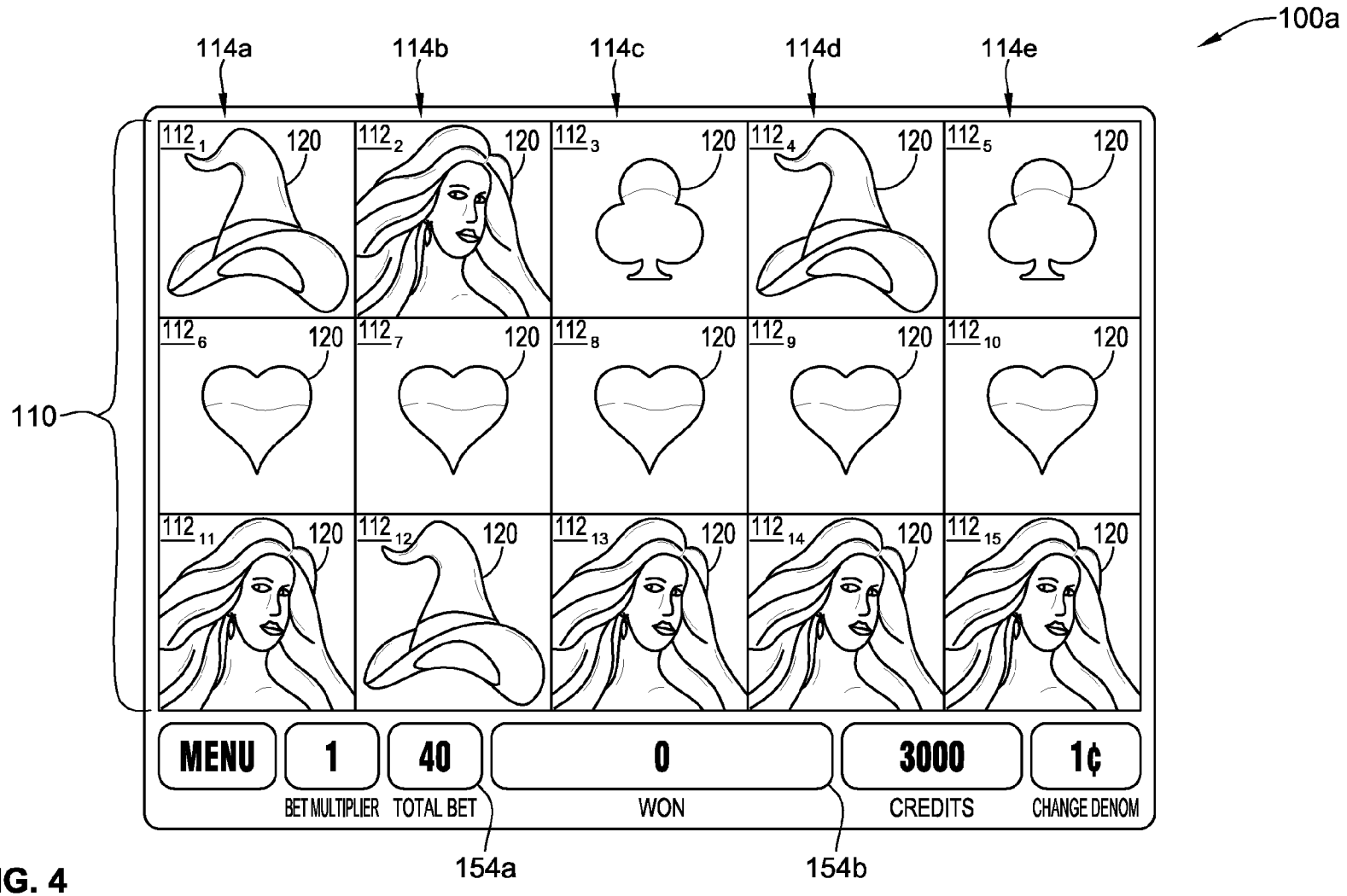
FIGS. 4-12 are screen shots of a display of the free-standing gaming terminal of FIG. 1 according to various aspects of the present disclosure.

A more specific description of the above general concepts is now provided. Referring specifically to FIG. 4, the screen shot 100*a* includes an array of symbol positions 110 used in conducting the wagering game. The array of symbol positions 110 is a 3×5 matrix of symbol positions $\mathbf{112}_{1\text{-}15}$ arranged in five columns 114*a-e* and three rows (i.e., fifteen symbol positions $\mathbf{112}_{1\text{-}15}$). The array of symbol positions 110 is formed by a plurality of symbol-bearing reels such that each of the columns 114*a-e* is occupied by a single one of the reels and each of the reels bears at least a portion of a plurality of symbols 120. The symbol bearing reels can be mechanical reels, displayed simulated reels, or a combination thereof. While the array of symbol positions 110 is shown as including five columns 114*a-e* and three symbol positions 112 per column (i.e., three rows of symbol positions), any number of columns and rows can be provided. For example, the array of symbol positions can include 1, 2, 3, 4, 10, 20, n, etc. columns with 1, 2, 3, 4, 10, m, etc. rows.

While the gaming terminal 10 (FIG. 1) conducts a play of the wagering game, each of the columns 114*a-e*, or each of the symbol-bearing reels, spins or illustrates a simulated spin (not shown) to appear as if each of the columns 114*a-e* is spinning prior to displaying an outcome of symbols (FIG. 4). At the beginning of a first play of the wagering game, all of the columns 114*a-e* spin and then stop spinning in a predetermined order (e.g., the first column 114*a* stops spinning first and displays its outcome, then the second column 114*b* stops and displays its outcome, etc.). As each column 114*a-e* stops spinning, a portion of a randomly selected outcome of symbols is displayed on the primary display area 12 and/or the secondary display area 14, until the entire outcome is displayed, as shown in FIG. 4.

Once the reels stop spinning and the outcome is displayed (FIG. 4), the outcome is evaluated to determine if it is a winning outcome. In the illustrated example, the wagering game has forty lines, which is apparent from the total bet of "40" shown in the game-session credit meter 154*a* (e.g., one credit is wagered for each of the lines). Each of the lines is associated with five of the symbol positions 112, one from each of the columns 114*a-e*. For example, a first one of the lines includes symbol positions $\mathbf{112}_{6\text{-}10}$ (which is a winning line), a second one of the lines includes symbol positions $\mathbf{112}_{1\text{-}5}$ (which is a losing line), and a third one of the lines includes symbol positions $\mathbf{112}_{11,\,7,\,3,\,9,\,15}$ (which is a losing line).

Whether the lines are winning lines or losing lines is determined with reference to the paytable. For purposes of the illustrated examples of FIGS. 4-12, the paytable of the wagering game dictates that a line is a winning line if the symbol positions associated with the line are associated with three or more symbols of the same kind, where the same kind of symbols are in adjacent ones of the columns 114*a-e*, and one of those symbols is in a symbol position $\mathbf{112}_{1,6,11}$ in the first column 114*a*. Thus, with reference to the three exemplary lines discussed above, the first one of the lines is a winning line because (a) the first line is associated with five symbol positions $\mathbf{112}_{6\text{-}10}$, which are each associated with one of five symbols of the same kind (e.g., a heart symbol 120 is associated with each of the symbol positions $\mathbf{112}_{6\text{-}10}$), (b) the five symbols of the same kind are in adjacent ones of the columns 114*a-e*, and (c) one of the five symbols of the same kind is in the first column 112*a*. However, the second and third ones of the lines are losing lines because the symbols positions associated with these lines (e.g., symbol positions $\mathbf{112}_{1\text{-}5}$ and $112_{11,7,3,9,15}$, respectively) are not associated with three or more symbols of the same kind.

With reference to FIG. 4, the outcome is a winning outcome because, of the forty lines, five of the lines are winning lines. That is, five of the lines are (a) associated with symbol positions 112 that are associated with three or more symbols 120 of the same kind, (b) the three or more symbols of the same kind are in adjacent or sequential ones of the columns 114*a-e*, and (c) one of the three or more symbols of the same kind is associated with a symbol position $112_{1,6,11}$ in the first column 114*a*. The five winning lines also means that the outcome includes winning symbols on five lines.

For purposes of the present disclosure, the five lines that are winning lines are as follows: the first winning line includes symbol positions $112_{11,2,13-15}$; the second winning line includes symbol positions $112_{6-10}$; the third winning line includes symbol positions $112_{6-9,5}$; the fourth winning line includes symbol positions $112_{6-8,4,10}$; and the fifth winning line includes symbol positions $112_{6-8,14,10}$. Similarly, the thirty-five other lines that are non-winning lines include five of the symbol positions $112_{1-15}$ that do not include three or more of the symbols 120 of the same kind in adjacent columns 114*a-e* starting with the first column 114*a*.

With reference to FIGS. 5-12, a method of conducting the wagering game of the present disclosure includes determining if the random outcome (FIG. 4) is a winning outcome (e.g., includes winning symbols on one or more lines). If the outcome is a winning outcome, various combinations of the winning symbols are highlighted in three separate and distinct stages to increase the player's excitement and the intelligibility of the winning outcome of the wagering game.

The first stage of highlighting includes highlighting all winning symbols on all winning lines (FIG. 5), the second stage of highlighting includes highlighting, in a sequential fashion, each group of winning symbols (FIGS. 6-7), and the third stage of highlighting includes highlighting, in a sequential fashion, the winning symbols on each line (FIGS. 8-12). Such a sequential highlighting of winning symbols in the three stages can help the player understand which of the symbols 120 contribute to the overall winning outcome and then to the individual winning lines.

Figure 5:
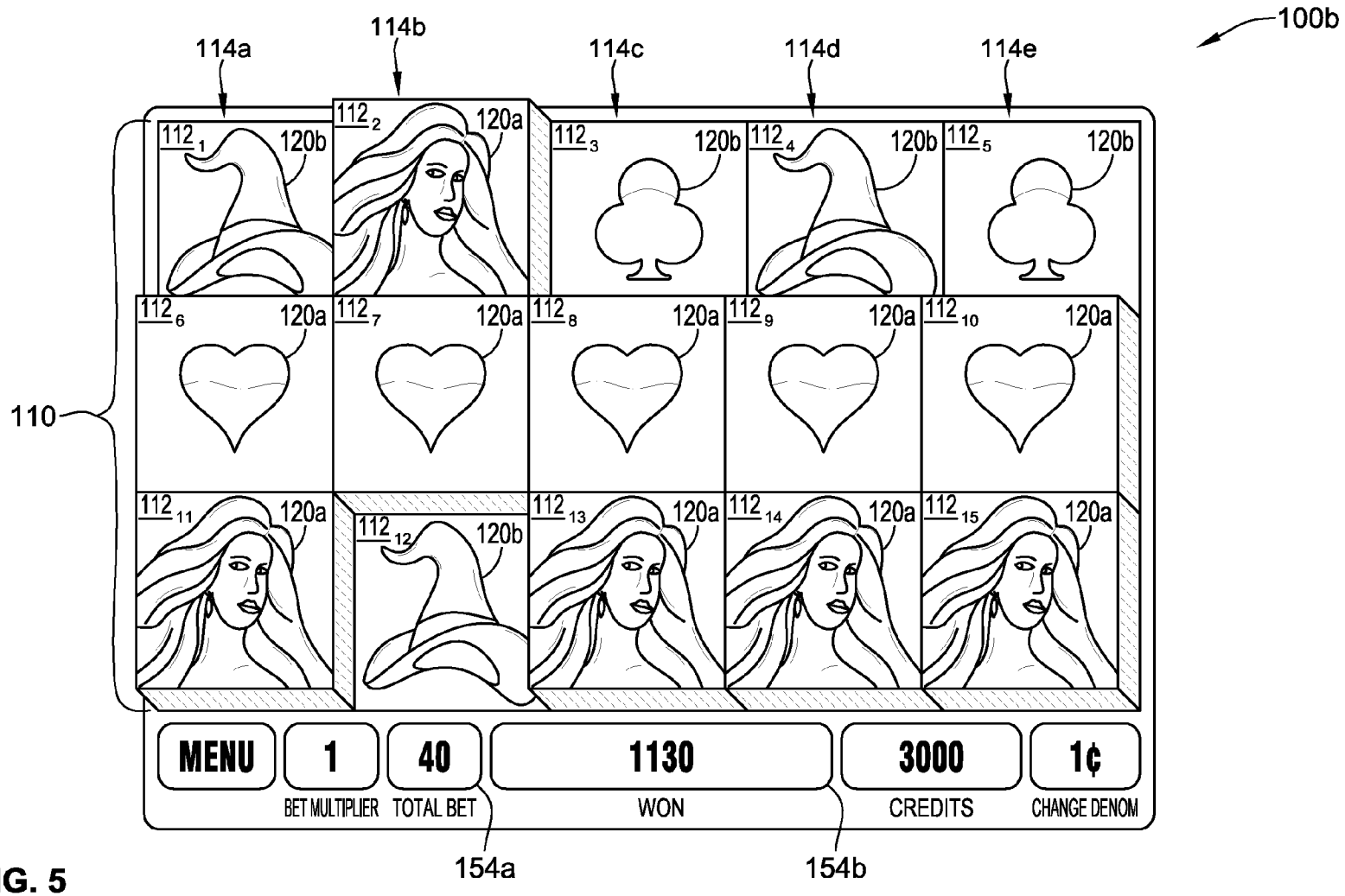

Thus, as the outcome is a winning outcome (FIG. 4), all of the winning symbols are highlighted as shown in FIG. 5—in accordance with the first stage of highlighting. Specifically, winning symbols 120*a* are highlighted as compared to non-winning symbols 120*b* by being raised from a first virtual plane to a second virtual plane. The visually highlighting of all of the winning symbols 120*a* in the screen shot 100*b* aids in focusing the player's attention to all of the winning symbols 120*a* that contributed to the outcome being a winning outcome. Thus, based on the sheer number of winning symbols 120*a* that are highlighted in response to the outcome being a winning outcome, the player can instantaneously get an idea of the scale of the winning outcome.

For example, if ten symbol positions 112 associated with ten respective winning symbols 120*a* are initially highlighted during the first stage of highlighting, the player can readily perceive that the winning outcome will be a relatively large winning outcome. That is, a player is likely to perceive a relatively large award when ten of the potential fifteen symbol positions 112 are associated with winning symbols 120*a*. Of course, depending on the awards in the paytable associated with each of the combinations of symbols, more or less winning symbols 120*a* can actually result in relatively larger or relatively smaller overall awards.

Figure 6:
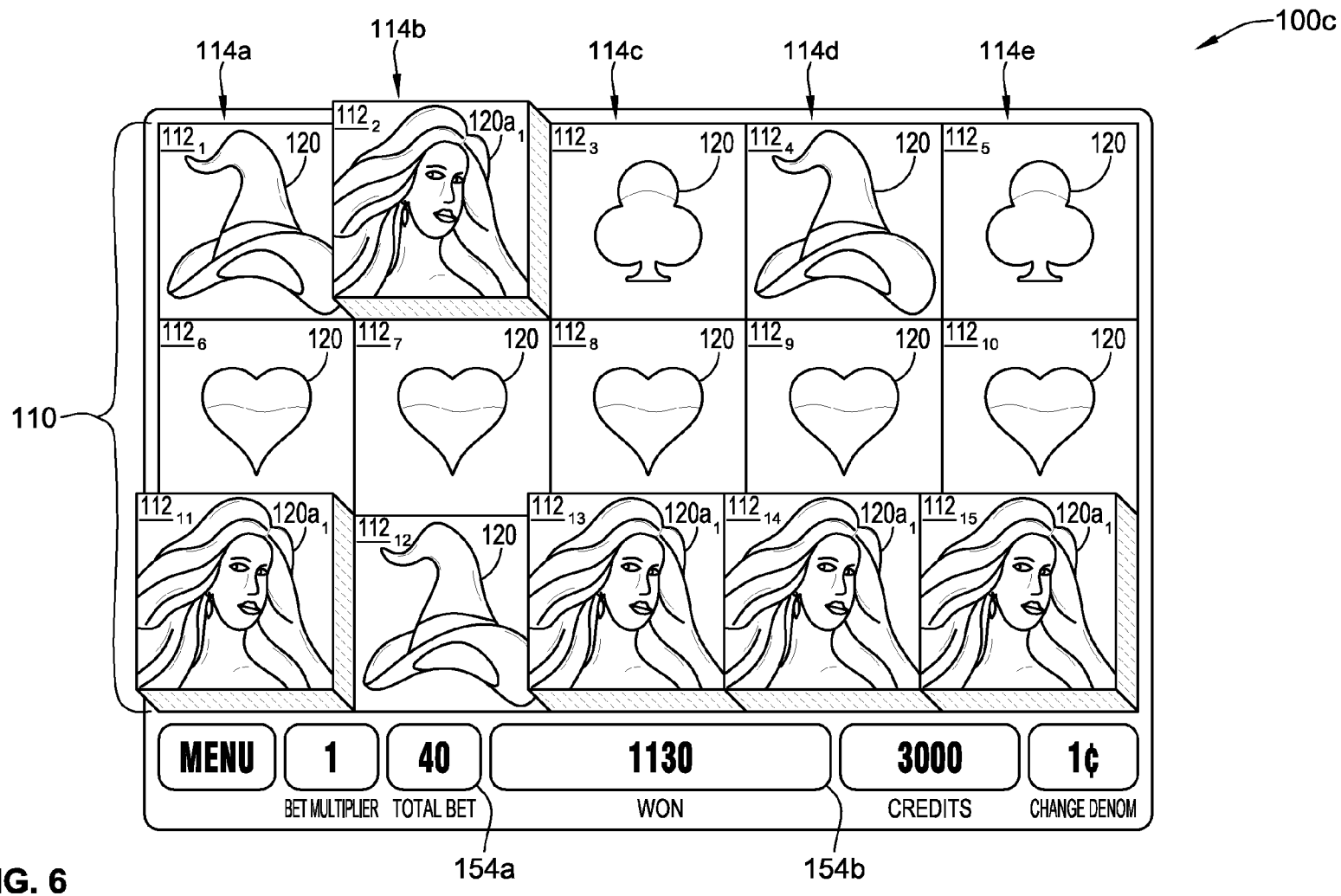
Figure 7:
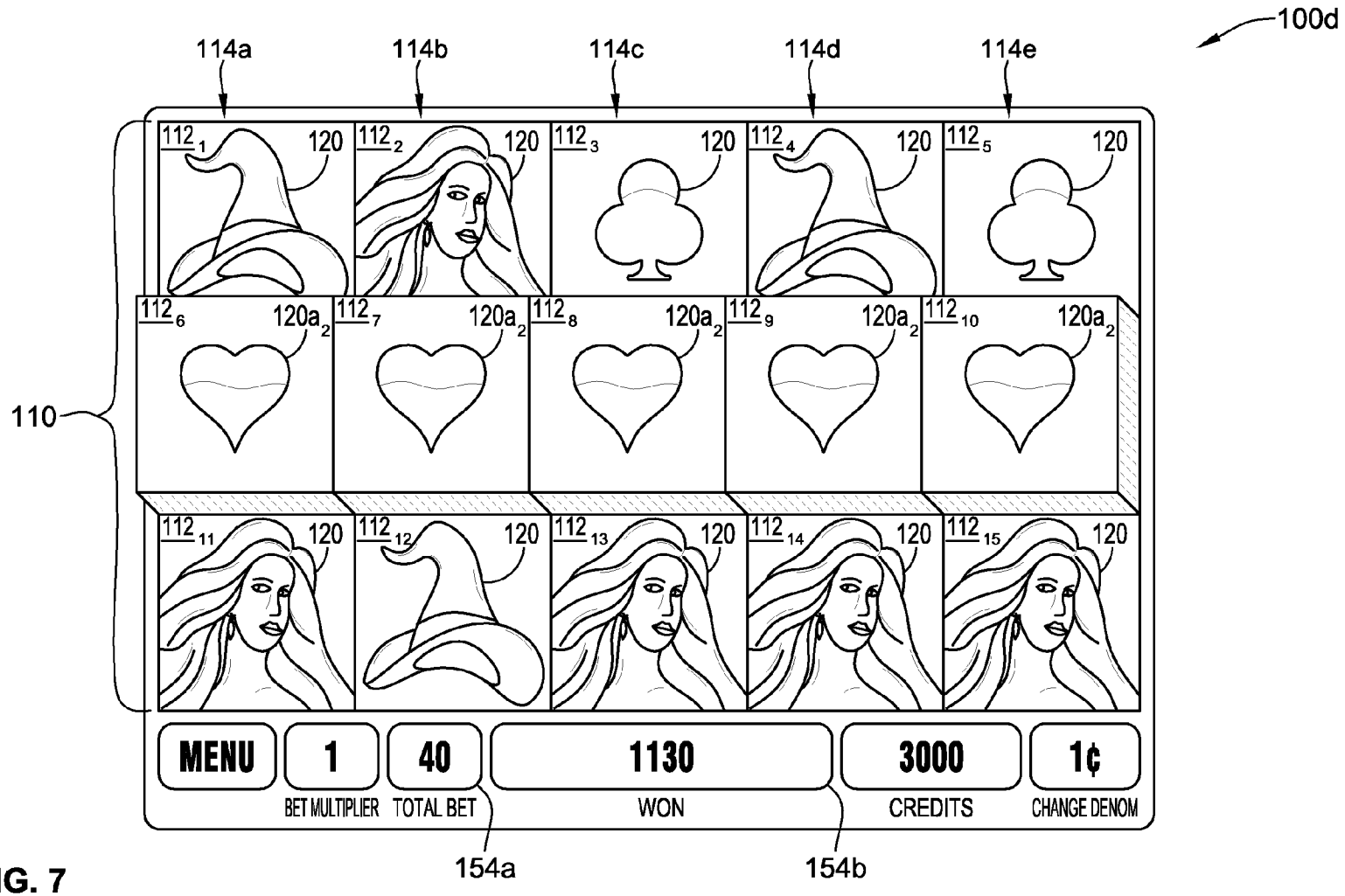

Subsequent to the first stage of highlighting, all of the winning symbols 120*a* are unhighlighted (e.g., visually returned from the second virtual plane to the first virtual plane) and each group of winning symbols is individually highlighted as shown in FIGS. 6 and 7—in accordance with the second stage of highlighting.

Specifically, a first group of winning symbols $120a_1$ is highlighted (FIG. 6) as compared to the symbols 120 that are not members of the first group of winning symbols $120a_1$ by being visually raised from the first virtual plane to the second virtual plane. The visually highlighting of the first group of winning symbols $120a_1$ in the screen shot 100*c* aids in focusing the player's attention to all of the symbols of a particular kind (e.g., face symbols) that contributed to the outcome being a winning outcome. Thus, based on a paytable value associated with the kind of symbol in the first group of winning symbols $120a_1$ and on the sheer number of the winning symbols $120a_1$ in the first group of winning symbols $120a_1$ that are highlighted, the player can instantaneously get an idea of the scale of the winning outcome associated with the kind of symbol in the first group of winning symbols $120a_1$.

For example, if the kind of winning symbol in the first group of winning symbols $120a_1$ is associated with a relatively higher award, as compared with other kinds of symbols 120 (e.g., face symbols are associated with higher awards than heart symbols), the highlighting, during the second stage of highlighting, of the first group of winning symbols $120a_1$ allows the player to readily perceive that the winning outcome—due to the first group of winning symbols $120a_1$—will be a relatively large winning outcome.

Subsequent to the first group of winning symbols $120a_1$ being highlighted in the second stage of highlighting, the first group of winning symbols $120a_1$ is unhighlighted and the second group of winning symbols $120a_2$ is highlighted as shown in FIG. 7—in accordance with the second stage of highlighting. Specifically, the second group of winning symbols $120a_2$ is highlighted (FIG. 7) as compared to the symbols 120 that are not members of the second group of winning symbols $120a_2$ by being visually raised from the first virtual plane to the second virtual plane. The visually highlighting of the second group of winning symbols $120a_2$ in the screen shot 100*d* aids in focusing the player's attention to all of the symbols of a particular kind (e.g., heart symbols) that contributed to the outcome being a winning outcome. Thus, based on a paytable value associated with the kind of symbol in the second group of winning symbols $120a_2$ and on the sheer number of the winning symbols $120a_2$ in the second group of winning symbols $120a_2$ that are highlighted, the player can instantaneously get an idea of the scale of the winning outcome associated with the kind of symbol in the second group of winning symbols $120a_2$.

The winning outcome of the present example only includes two groups of winning symbols (e.g., the first and second groups of winning symbols $120a_1$, $120a_2$). Thus, subsequent to highlighting the second group of winning symbols $120a_2$ in the second stage of highlighting, the second group of winning symbols $120a_2$ is unhighlighted and (a) the array of symbol positions 110 is scaled back (e.g., reduced in size and/or shrunken) to reveal a win stack area 160 and (b) the winning symbols on each line are individually highlighted in a sequential fashion as shown in FIGS. 8-12—in accordance with the third stage of highlighting. The scaling back of the array of symbol positions 110 can occur prior to (e.g., immediately prior to) or at the same time that the winning symbols on the lines are highlighted in the sequential fashion.

The win stack area 160 is displayed on the primary and/or the secondary display areas 12, 14 for the duration of the third stage of highlighting and/or until a next play of the wagering game is initiated (e.g., by the player pressing the spin reels or max bet spin buttons 56). The win stack area 160 provides (a) representations 162*a-e* (FIGS. 8-12) of each winning line and the winning symbols on each winning line and (b) associated award values 164*a-e*. The representations 162*a-e* and the associated award values 164*a-e* are sequentially displayed in the win stack area 160 at the same time (e.g., simultaneous) that the winning symbols on corresponding lines are visually highlighted in the array of symbol position 110. Optionally, the representations 162*a-e* and the associated award values 164*a-e* can be repeatedly displayed in a sequential fashion (along with the winning symbols on corresponding lines) for the duration of the third stage of highlighting and/or until a next play of the wagering game is initiated.

Each of the representations 162*a-e* include a scaled down representative array 163*a'-e'* (e.g., scale of 1 to 10, etc.) with representative symbol positions corresponding to the symbol positions $\mathbf{112}_{1\text{-}15}$ of the array of symbol positions 110. For winning symbols on a given line, ones of the representative symbol positions corresponding to the symbol positions 112 associated with the winning symbols on the given line are shaded in a first fashion; and ones of the representative symbol positions corresponding to the symbol positions 112 associated with the non-contributing symbols on the given line, if any, are shaded in a second fashion. The rest of the representative symbol positions not corresponding to the given line are unshaded. Such shading of the representative symbol positions of the scaled down representative arrays 163*a'-e'* aid in identifying the lines corresponding with the respective highlighted winning symbols on the lines—in accordance with the third stage of highlighting. Additionally, for winning symbols on a given line, the representations 162*a-e* include scaled down representative winning symbols 163*a"-e"* for each winning symbol on the given line.

Figure 8:
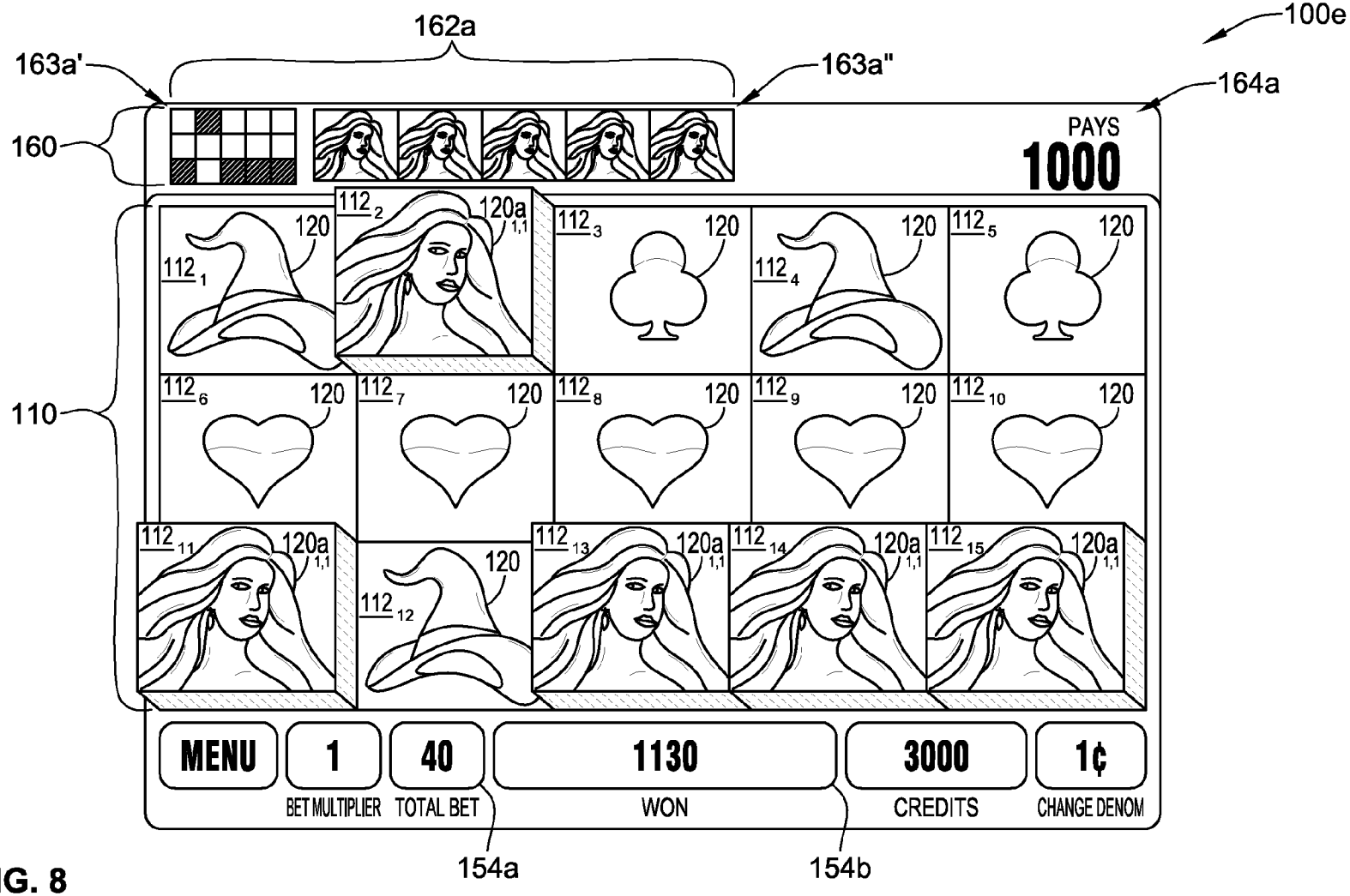

Referring to FIG. 8, winning symbols $\mathbf{120}a_{1,1}$ on a first line of the first group of winning symbols $\mathbf{120}a_1$ are highlighted as compared to the symbols 120 that are not winning symbols $\mathbf{120}a_{1,1}$ on the first line—in accordance with the third stage of highlighting—as shown in the screen shot 100*e*. Specifically, the winning symbols $\mathbf{120}a_{1,1}$ on the first line are visually highlighted by being visually raised from the first virtual plane to the second virtual plane. The visually highlighting of the winning symbols $\mathbf{120}a_{1,1}$ on the first line in the screen shot 100*e* aids in focusing the player's attention to the specific winning symbols $\mathbf{120}a_{1,1}$ that contribute to the first line (formed by symbol positions $\mathbf{112}_{11,\ 2,\ 13\text{-}15}$) being the first winning line of the forty lines.

The representation 162*a* and the associated award value 164*a* are displayed in the win stack area 160 at the same time (e.g., simultaneously) that the winning symbols $\mathbf{120}a_{1,1}$ on the first line are visually highlighted—in accordance with the third stage of highlighting. The scaled down representative array 163*a'* illustrates a representation of the first winning line—formed by the symbol positions $\mathbf{112}_{11,\ 2,\ 13\text{-}15}$ of the array of 110—and the winning symbols $\mathbf{120}a_{1,1}$ thereon. Specifically, as the winning symbols $\mathbf{120}a_{1,1}$ on the first line includes five winning symbols corresponding with all five of the symbol positions $\mathbf{112}_{11,2,13\text{-}15}$ of the first winning line (e.g., zero non-contributing symbols), the five representative symbol positions in the scaled down representative array 163*a'* that correspond with the five symbol positions $\mathbf{112}_{11,2,\ 13\text{-}15}$ of the first winning line are shaded in the first fashion. Additionally, five scaled down representative winning symbols 163*a"* are included in the win stack area 160. Such a display of the representation 162*a* and the associated award value 164*a* aids the player in understanding which specific line (e.g., the first winning line formed by symbol positions $\mathbf{112}_{11,\ 2,\ 13\text{-}15}$) and winning symbols thereon contributed to the outcome being a winning outcome and what the corresponding award value is for that winning line.

Figure 9:
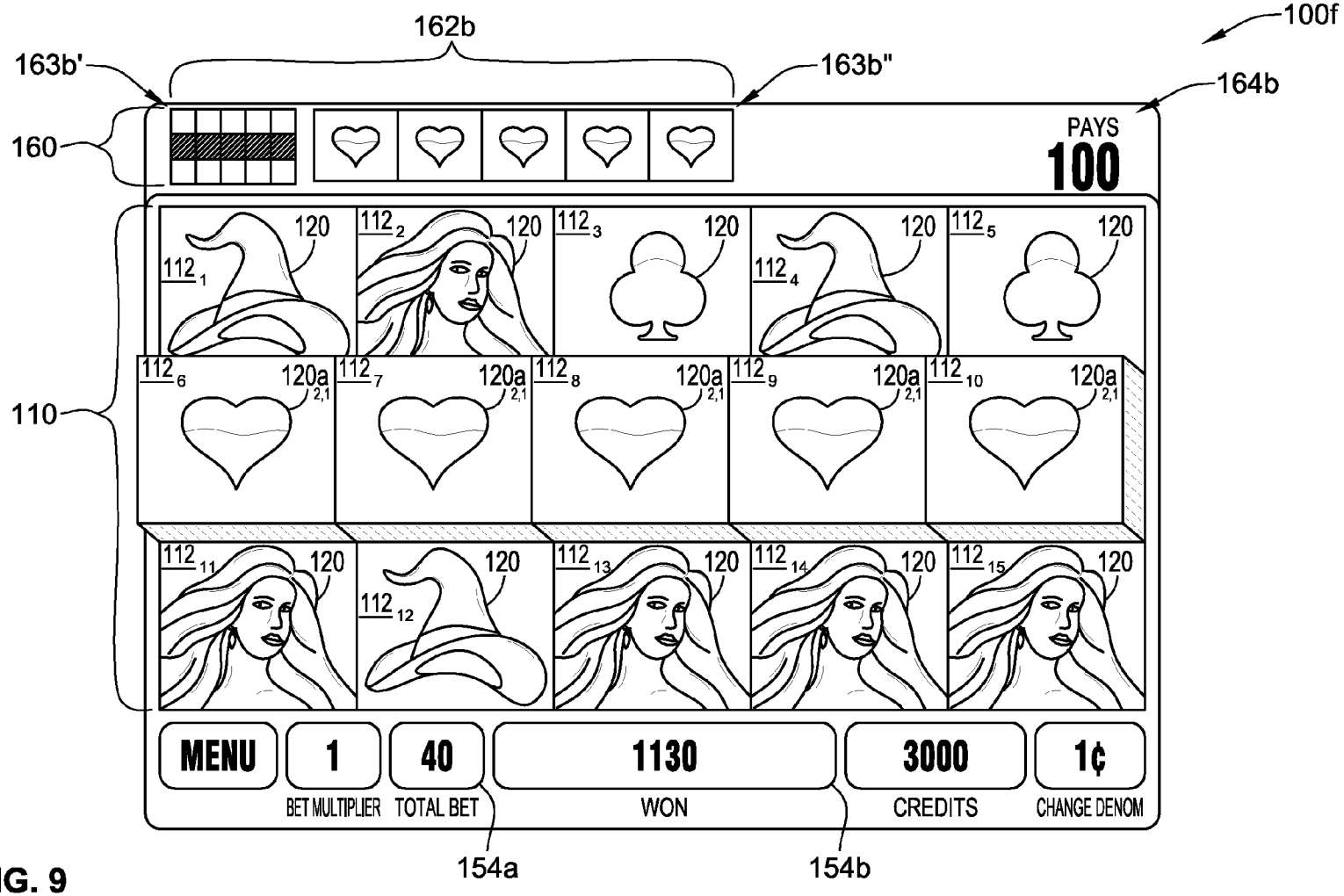

Referring to FIG. 9, subsequent to highlighting the winning symbols $\mathbf{120}a_{1,1}$ on the first line of the first group of winning symbols $\mathbf{120}a_1$ in the third stage of highlighting, the winning symbols $\mathbf{120}a_{1,1}$ on the first line are unhighlighted and winning symbols $\mathbf{120}a_{2,1}$ on a first line of the second group of winning symbols $\mathbf{120}a_2$ is highlighted as compared to the symbols 120 that are not winning symbols $\mathbf{120}a_{2,1}$ on the first line—in accordance with the third stage of highlighting—as shown in the screen shot 100*f*. Specifically, the winning symbols $\mathbf{120}a_{2,1}$ on the first line are visually highlighted by being visually raised from the first virtual plane to the second virtual plane. The visually highlighting of the winning symbols $\mathbf{120}a_{2,1}$ on the first line in the screen shot 100*f* aids in focusing the player's attention to the specific winning symbols $\mathbf{120}a_{2,1}$ that contribute to the line (formed by symbol positions $\mathbf{112}_{6\text{-}10}$) being the second winning line of the forty lines.

The representation 162*b* and the associated award value 164*b* are displayed in the win stack area 160 at the same time (e.g., simultaneously) that the winning symbols $\mathbf{120}a_{2,1}$ on the first line are visually highlighted—in accordance with the third stage of highlighting. The scaled down representative array 163*b'* illustrates a representation of the second winning line—formed by the symbol positions $\mathbf{112}_{6\text{-}10}$ of the array of 110—and the winning symbols $\mathbf{120}a_{2,1}$ thereon. Specifically, as the winning symbols $\mathbf{120}a_{2,1}$ on the first line include five winning symbols corresponding with all five of the symbol positions $\mathbf{112}_{6\text{-}10}$ of the second winning line (e.g., zero non-contributing symbols), the five representative symbol positions in the scaled down representative array 163*b'* that correspond with the five symbol positions $\mathbf{112}_{6\text{-}10}$ of the second winning line are shaded in the first fashion. Additionally, five scaled down representative winning symbols 163*b"* are included in the win stack area 160. Such a display of the representation 162*b* and the associated award value 164*b* aids the player in understanding which specific line (e.g., the second winning line formed by symbol positions $\mathbf{112}_{6\text{-}10}$) and winning symbols thereon contributed to the outcome being a winning outcome and what the corresponding award value is for that winning line.

Figure 10:
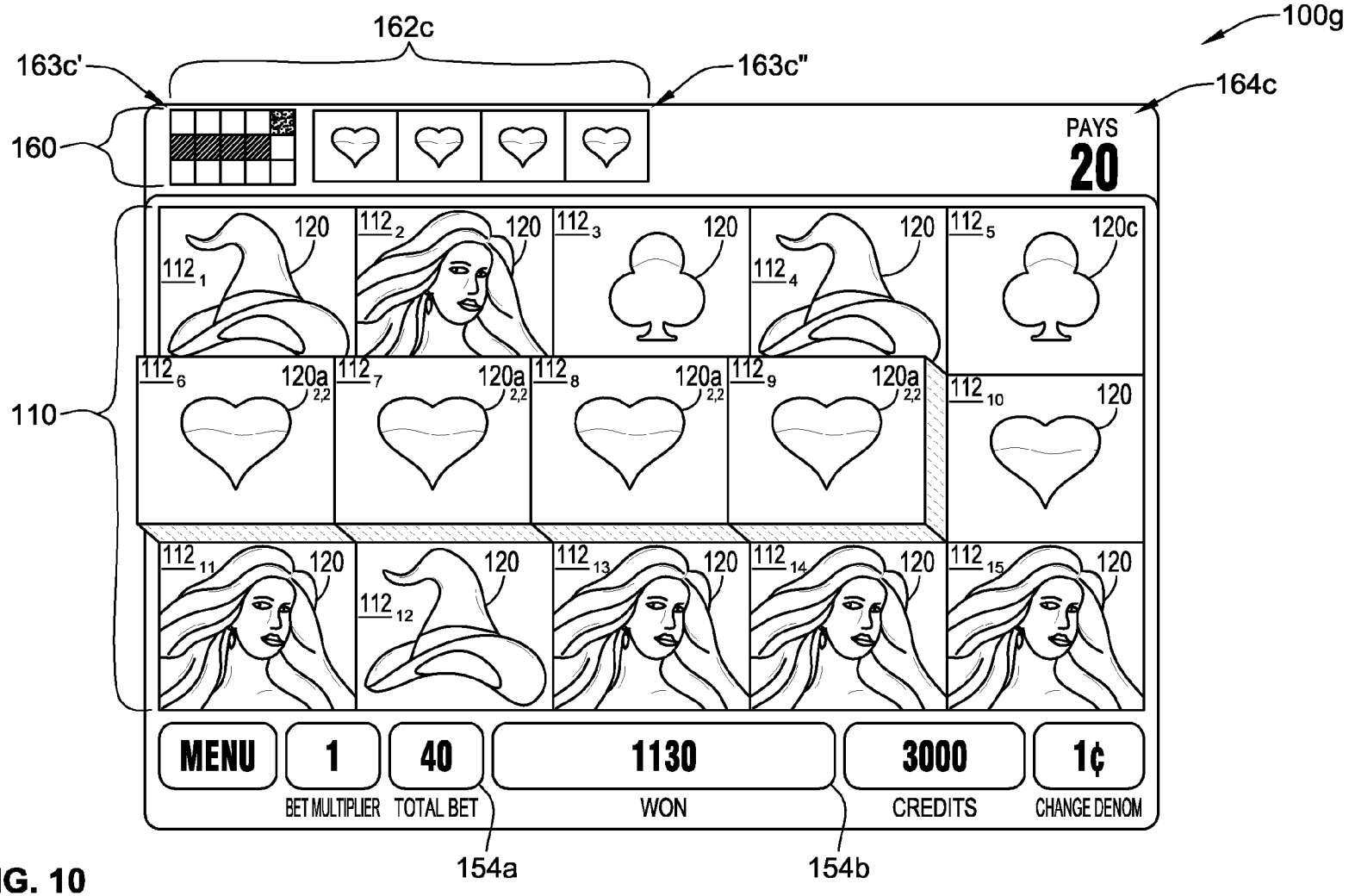

Referring to FIG. 10, subsequent to highlighting the winning symbols $\mathbf{120}a_{2,1}$ on the first line of the second group of winning symbols $\mathbf{120}a_2$ in the third stage of highlighting, the winning symbols $\mathbf{120}a_{2,1}$ on the first line are unhighlighted and winning symbols $\mathbf{120}a_{2,2}$ on a second line of the second group of winning symbols $\mathbf{120}a_2$ is highlighted as compared to the symbols 120 that are not winning symbols $\mathbf{120}a_{2,2}$ on the second line—in accordance with the third stage of highlighting—as shown in the screen shot 100*g*. Specifically, the winning symbols $\mathbf{120}a_{2,2}$ on the second line are visually highlighted by being visually raised from the first virtual plane to the second virtual plane. The visually highlighting of the winning symbols $\mathbf{120}a_{2,2}$ on the second line in the screen shot 100*g* aids in focusing the player's attention to the specific winning symbols $\mathbf{120}a_{2,2}$ that contribute to the line (formed by symbol positions $\mathbf{112}_{6\text{-}9,\ 5}$) being the third winning line of the forty lines.

The representation 162*c* and the associated award value 164*c* are displayed in the win stack area 160 at the same time (e.g., simultaneously) that the winning symbols $\mathbf{120}a_{2,2}$ on the second line are visually highlighted—in accordance with the third stage of highlighting. The scaled down representative array 163*c'* illustrates a representation of the third winning line—formed by the symbol positions $\mathbf{112}_{6\text{-}9,5}$ of the array of 110—and the winning symbols $\mathbf{120}a_{2,2}$ thereon. Specifically, the winning symbols 120$a_{2,2}$ on the second line include four winning symbols 120$a_{2,2}$ associated with four of the symbol positions 112$_{6\text{-}9}$ of the third winning line and one non-contributing symbol 120*c* associated with the symbol position 112$_5$ of the third winning line. Thus, the four representative symbol positions in the scaled down representative array 163*c*' that correspond with the four symbol positions 112$_{6\text{-}9}$ of the third winning line are shaded in the first fashion. Similarly, the one representative symbol position in the scaled down representative array 163*c*' that corresponds with the symbol position 112$_5$ associated with the non-contributing symbol 120*c* of the third winning line is shaded in the second fashion. Additionally, four scaled down representative winning symbols 163*c*" are included in the win stack area 160. Such a display of the representation 162*c* and the associated award value 164*c* aids the player in understanding which specific line (e.g., the third winning line formed by symbol positions 112$_{6\text{-}9,5}$) and winning symbols thereon contributed to the outcome being a winning outcome and what the corresponding award value is for that winning line.

Figure 11:
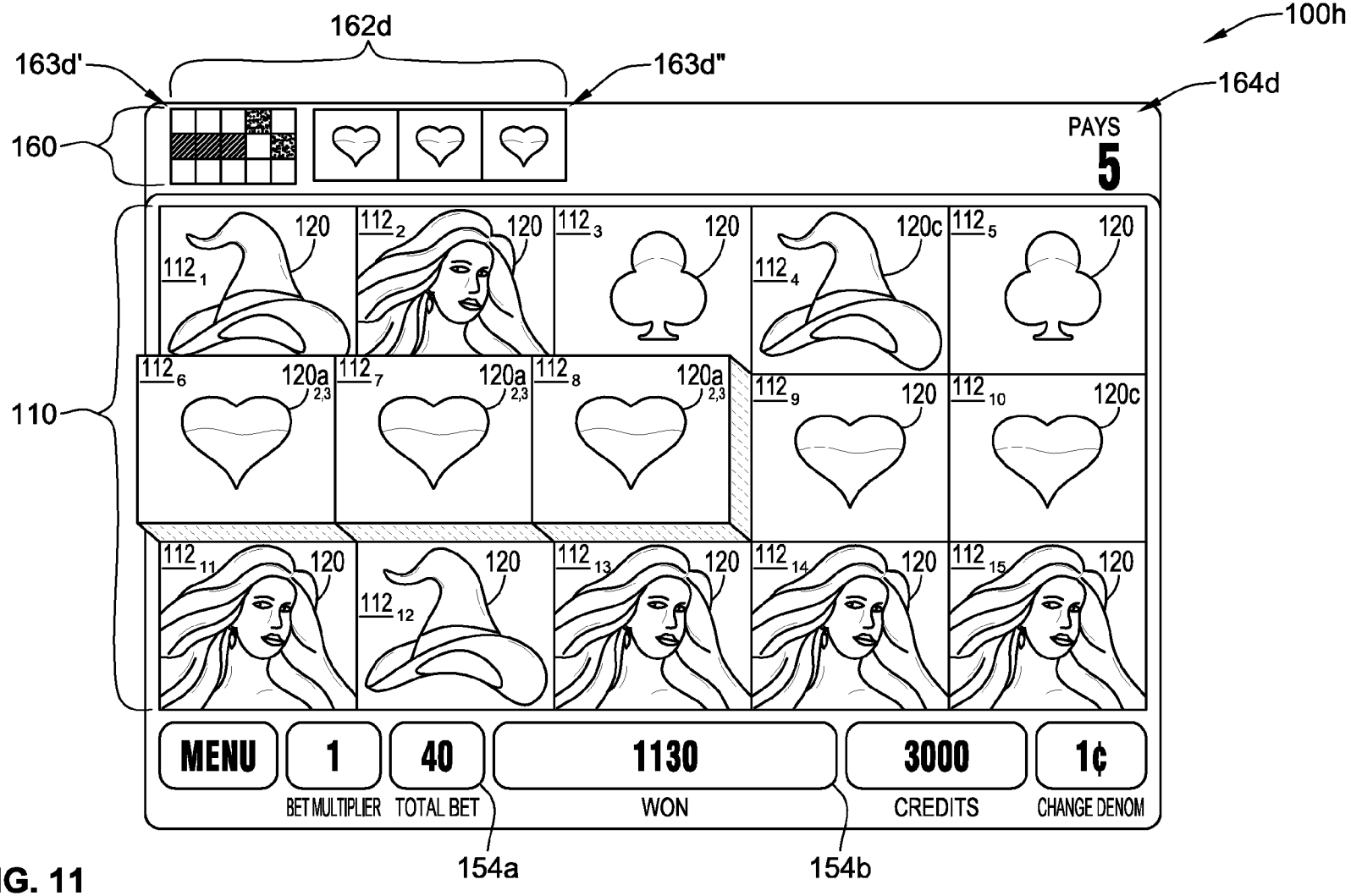
Figure 12:
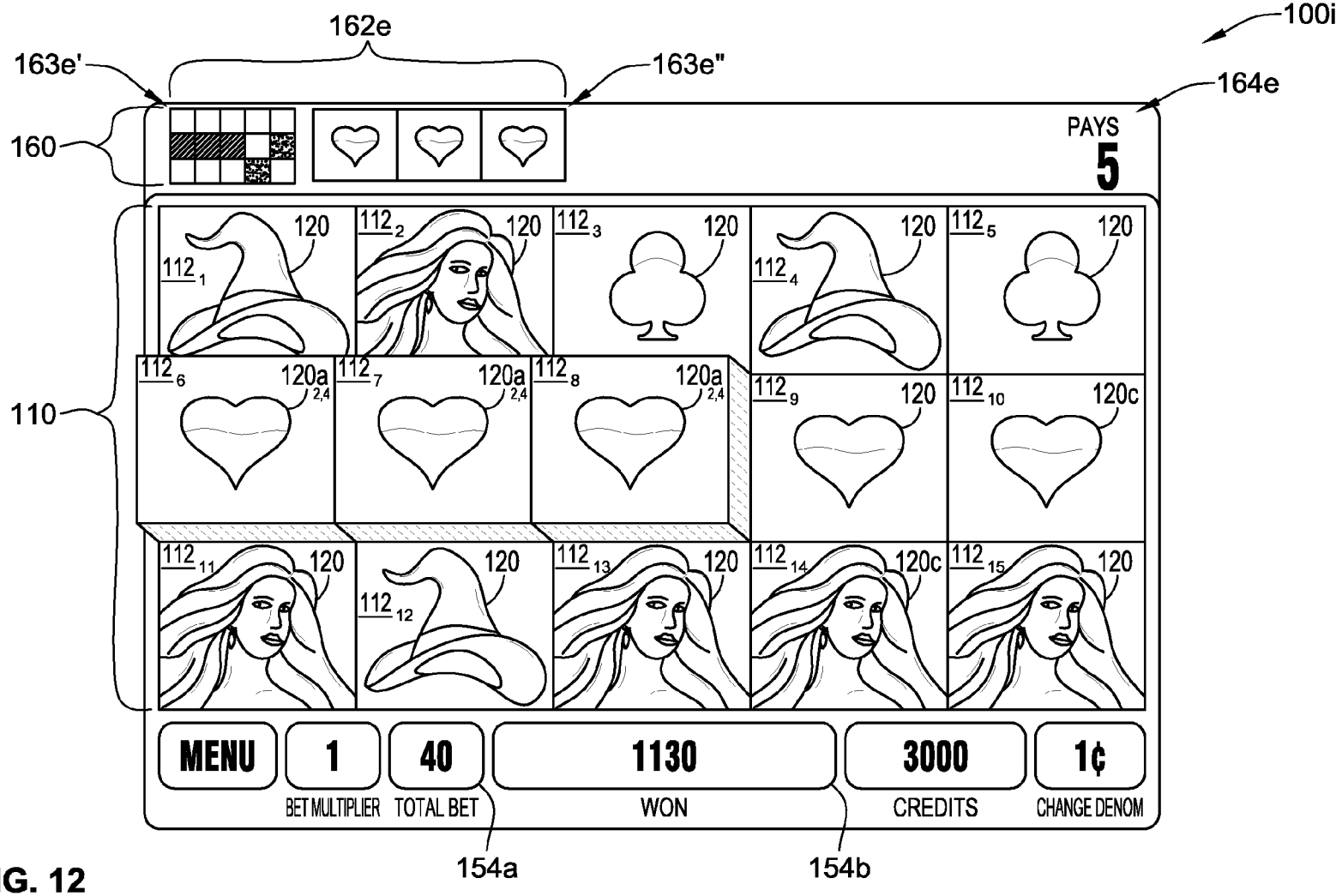

Referring to FIG. 11, subsequent to highlighting the winning symbols 120$a_{2,2}$ on the second line of the second group of winning symbols 120$a_2$ in the third stage of highlighting, the winning symbols 120$a_{2,2}$ on the second line are unhighlighted and winning symbols 120$a_{2,3}$ on a third line of the second group of winning symbols 120$a_2$ is highlighted as compared to the symbols 120 that are not winning symbols 120$a_{2,3}$ on the third line—in accordance with the third stage of highlighting—as shown in the screen shot 100*h*. Specifically, the winning symbols 120$a_{2,3}$ on the third line are visually highlighted by being visually raised from the first virtual plane to the second virtual plane. The visually highlighting of the winning symbols 120$a_{2,3}$ on the third line in the screen shot 100*h* aids in focusing the player's attention to the specific winning symbols 120$a_{2,3}$ that contribute to the line (formed by symbol positions 112$_{6\text{-}8,4,10}$) being the fourth winning line of the forty lines.

The representation 162*d* and the associated award value 164*d* are displayed in the win stack area 160 at the same time (e.g., simultaneously) that the winning symbols 120$a_{2,3}$ on the third line are visually highlighted—in accordance with the third stage of highlighting. The scaled down representative array 163*d*' illustrates a representation of the fourth winning line—formed by the symbol positions 112$_{6\text{-}8,4,10}$ of the array of 110—and the winning symbols 120$a_{2,3}$ thereon. Specifically, the winning symbols 120$a_{2,3}$ on the third line include three winning symbols 120$a_{2,3}$ associated with three of the symbol positions 112$_{6\text{-}8}$ of the fourth winning line and two non-contributing symbols 120*c* associated with the two symbol positions 112$_{4,10}$ of the fourth winning line. Thus, the three representative symbol positions in the scaled down representative array 163*d*' that correspond with the three symbol positions 112$_{6\text{-}8}$ of the fourth winning line are shaded in the first fashion. Similarly, the two representative symbol positions in the scaled down representative array 163*d*' that correspond with the two symbol positions 112$_{4,10}$ associated with the two non-contributing symbols 120*c* of the fourth winning line are shaded in the second fashion. Additionally, three scaled down representative winning symbols 163*d*" are included in the win stack area 160. Such a display of the representation 162*d* and the associated award value 164*d* aids the player in understanding which specific line (e.g., the fourth winning line formed by symbol positions 112$_{6\text{-}8,4,10}$) and winning symbols thereon contributed to the outcome being a winning outcome and what the corresponding award value is for that winning line.

Referring to FIG. 12, subsequent to highlighting the winning symbols 120$a_{2,3}$ on the third line of the second group of winning symbols 120$a_2$ in the third stage of highlighting, the winning symbols 120$a_{2,3}$ on the third line are unhighlighted and winning symbols 120$a_{2,4}$ on a fourth line of the second group of winning symbols 120$a_2$ are highlighted as compared to the symbols 120 that are not winning symbols 120$a_{2,4}$ on the fourth line—in accordance with the third stage of highlighting—as shown in the screen shot 100*i*. Specifically, the winning symbols 120$a_{2,4}$ on fourth line are visually highlighted by being visually raised from the first virtual plane to the second virtual plane. The visually highlighting of the winning symbols 120$a_{2,4}$ on the fourth line in the screen shot 100*i* aids in focusing the player's attention to the specific winning symbols 120$a_{2,4}$ that contribute to the line (formed by symbol positions 112$_{6\text{-}8,14,10}$) being the fifth winning line of the forty lines.

The representation 162*e* and the associated award value 164*e* are displayed in the win stack area 160 at the same time (e.g., simultaneously) that the winning symbols 120$a_{2,4}$ on fourth line are visually highlighted—in accordance with the third stage of highlighting. The scaled down representative array 163*e*' illustrates a representation of the fifth winning line—formed by the symbol positions 112$_{6\text{-}8,14,10}$ of the array of 110—and the winning symbols 120$a_{2,4}$ thereon. Specifically, the winning symbols 120$a_{2,4}$ on the fourth line include three winning symbols 120$a_{2,4}$ associated with three of the symbol positions 112$_{6\text{-}8}$ of the fifth winning line and two non-contributing symbols 120*c* associated with two of the symbol positions 112$_{14,10}$ of the fifth winning line. Thus, the three representative symbol positions in the scaled down representative array 163*e*' that correspond with the three symbol positions 112$_{6\text{-}8}$ of the fifth winning line are shaded in the first fashion. Similarly, the two representative symbol positions in the scaled down representative array 163*e*' that correspond with the two symbol positions 112$_{14,10}$ associated with the two non-contributing symbols 120*c* of the fifth winning line are shaded in the second fashion. Additionally, three scaled down representative winning symbols 163*e*" are included in the win stack area 160. Such a display of the representation 162*e* and the associated award value 164*e* aids the player in understanding which specific line (e.g., the fifth winning line formed by symbol positions 112$_{6\text{-}8,14,10}$) and winning symbols thereon contributed to the outcome being a winning outcome and what the corresponding award value is for that winning line.

At the conclusion of the third stage of highlighting (e.g., when a next play of the wagering game is initiated), the array of symbol positions 110 is rescaled to its previous size (e.g., as shown in FIGS. 4-7), thereby obscuring the win stack area 160, and another random outcome is displayed and the above method, including the three stages of highlighting, can be repeated.

As discussed above, a line is a winning payline if (a) the symbol positions associated with the line are associated with three or more symbols of the same kind, (b) where the three or more same kind of symbols are in adjacent ones of the columns 114*a-e*, and (c) one of those three or more same kind of symbols is associated with one of the symbol positions 112$_{1,6,11}$ in the first column 114*a*. Various other and/or different requirements can be imposed for a line to be a winning line. For example, in some concepts, the three or more symbols 120 of the same kind do not need to be associated with symbol positions in adjacent and/or sequential ones of the columns 114*a-e* of the array of symbol positions 110 (e.g., scatter games, any way games, and/or any pay games). For another example, evaluation of the line does not need to start from the first column 114*a*. Thus, one of the three or more symbols 120 of the same kind does not need to be associated with the first column 114*a*. For yet another example, a wild symbol (not shown) can act as a symbol of any other kind to aid in forming a winning line.

As discussed above, in the illustrated example of FIGS. 4-12, the wagering game has forty lines. In the above illustrated examples, all of the forty lines were active lines as the wager was 40 credits (e.g., one credit to activate each of the forty potential lines). However, depending on the size of the array of symbol positions, the wagering game can include any number of lines and any number of active lines (depending on the size of the wager). Further, each line can be associated with any number of symbol positions 112.

While the present disclosure discusses and uses lines (e.g., paylines, ways, etc.) in determining winning outcomes, no visual representations of lines are shown across the array of symbol positions 110 in any of the disclosed concepts of FIGS. 4-12, as compared with the prior example of FIG. 3, which includes visual representations of paylines 58 across the simulated symbol-bearing reels 52 (e.g., array of symbol positions). The absence of the visual lines (e.g., paylines 58) across the array of symbol positions 110 in the disclosed concepts of FIGS. 4-12 reduces the visual clutter associated with wagering games with multiple lines (10, 20, 40, 100, etc.). Further, the disclosed concepts of FIGS. 4-12 include the optional win stack area 160 with representations 162*a-e* of the winning lines and winning symbols thereon—displayed during the third stage of the highlighting—for players interested in seeing such granular information when achieving a winning outcome.

While the winning symbols 120*a*, the groups of winning symbols $\mathbf{120}a_1$ and $\mathbf{120}a_2$, and the winning symbols $\mathbf{120}a_{1,1}$ and $\mathbf{120}a_{2,1\text{-}4}$ on the lines are described as highlighted by being visually raised from a first virtual plane to a second virtual plane, each of the winning symbols can be highlighted by any of the following manners, in lieu of, or in addition thereto: (1) surrounding each of the winning symbols with a window (not shown), such as, for example, a boarder, and (2) visually enlarging the winning symbol and/or the associated symbol position such that the winning symbols and/or associated symbol positions are visually larger than the non-winning and/or non-contributing symbols 120*b*, 120*c* and/or the associated symbol positions.

As described herein, the winning symbols 120*a*, the groups of winning symbols $\mathbf{120}a_1$ and $\mathbf{120}a_2$, and the winning symbols $\mathbf{120}a_{1,1}$ and $\mathbf{120}a_{2,1\text{-}4}$ on the lines are highlighted by being raised from a first virtual plane to a second virtual plane. The virtual planes can be displayed on the same physical display or on a combination of two or more physical displays (e.g., using one or more transmissive displays). For example, if one physical display is used to display two or more virtual planes, the one display can virtually illustrate different virtual planes on the same display. For another example, if two displays are used, one display overlays the other and is offset therefrom in a Z direction (where each of the displays lies substantially in a respective plane formed in an X-Y plane). Thus, a first one of the displays lies in a first X-Y plane and the second one of the displays lies in a second X-Y plane that is offset from the first display in the Z direction.

By the term raised into a different virtual plane it is meant that a winning symbol 120*a* and/or associated symbol position 112 is visually altered to appear to be closer to the player of the wagering game as compared to the symbol and/or symbol position before it was raised. Put another way, the winning symbol 120*a* and/or associated symbol position 112 is physically translated (e.g., multiple layered and/or transmissive displays) and/or virtually translated (e.g., single display) along a Z-axis wherein the primary and/or secondary display areas 12, 14 lie in a plane defined by the X and Y axes and wherein each of the virtual planes is defined by a plane defined by the X and Y axes (e.g., single display) or by respective planes that lie in two or more X-Y planes along a common Z-axis (e.g., multiple layered and/or transmissive displays).

Alternatively to the array of symbol positions 110 being scaled back (e.g., reduced in size) to reveal the win stack area 160, the win stack area 160 can be constantly and/or selectively displayed on the primary and/or secondary display areas 12, 14. For example, the win stack area 160 can be constantly displayed above the array of symbol positions 110 on the primary display area 12. For another example, the player can selectively display the win stack area 160 above the array of symbol positions 110 on the primary and/or secondary display areas 12, 14.

Additionally, the win stack area 160 can be displayed on one or more individual button panels or on a button panel area (e.g., touchscreen button panel) positioned below the primary display area 12. In such an alternative, the win stack area 160 can be constantly displayed on the button panel area or only during the third stage of highlighting. Further, in such an alternative, there is no need to scale back the array of symbol positions 110 to reveal the win stack area 160. Whether the win stack area 160 is constantly displayed, for example, on primary and/or secondary display areas 12, 14, on the button panel area, only during the third stage of highlighting, never (e.g., the player can selectively decide to never display the win stack area 160 feature), can be a stored setting for a player that is associated with the player's gaming card and/or player track card.

Referring generally to FIGS. 4-12, a game-session credit meter 154*b* is shown for indicating an amount of total credits awarded to the player for the play of the wagering game. Specifically, for the play of the wagering game illustrated in FIGS. 4-12, the player is awarded one thousand credits for the first winning line (FIG. 8), one hundred credits for the second winning line (FIG. 9), twenty credits for the third winning line (FIG. 10), five credits for the fourth winning line (FIG. 11), and five credits for the fifth winning line (FIG. 12), for a total of one thousand one hundred and thirty credits, which is indicated in the game-session credit meter 154*b* (FIGS. 5-12). In some implementations of these concepts, the game-session credit meter 154*b* dynamically displays the total awarded credits by visually displaying an accumulation of credits from zero to the total amount won (e.g., 1130 credits) after displaying the outcome, also known as a credit award bang-up display or bang-up feature. The credit award bang-up display is typically accompanied by sound effects that add excitement to the game as the player can watch the won credits add up. The length of the bang-up display is based on the amount of the total award. A larger award takes longer for the bang-up to be displayed as compared to a relatively smaller award. For example, the bang-up display for an award of one hundred credits might take three seconds and the bang-up display for an award of five thousand credits might take twenty seconds. In some implementations of the present concepts, the first and second stages of highlighting are sequentially conducted in a repeating manner (e.g., the first stage is conducted, followed by the second stage, followed by the first stage again, etc.) during the bang-up. In such implementations, the third stage of highlighting begins when the bang-up concludes (e.g., the total amount of awarded credits appears in the game-session credit meter 154*b*).

Alternatively to the groups of winning symbols being defined as all of the winning symbols of the same kind on one or more lines, the groups of winning symbols that are highlighted during the second stage of highlighting can be defined by any other manner. For example, the groups of winning symbols can be defined by the number of winning symbols on the lines. In such an example, all of the three-of-a-kind arrangements of winning symbols form a first of the groups, all of the four-of-a-kind arrangements of winning symbols form a second of the groups, all of the five-of-a-kind arrangements of winning symbols form a third of the groups, etc.

While the second stage of highlighting is shown as highlighting the first group of winning symbols 120$a_1$ (FIG. 6) followed by highlighting the second group of winning symbols 120$a_2$ (FIG. 7), the order of the highlighting of the groups of winning symbols during the second stage of highlighting can be determined based on the total amount of credits awarded to the player based on the underlying winning symbols on the lines that comprise the groups. As shown in the example of FIGS. 4-12, the first group of winning symbols 120$a_1$ includes winning symbols 120$a_{1,1}$ on one line that is associated with an award of one thousand credits and the second group of winning symbols 120$a_2$ includes winning symbols 120$a_{1,1\text{-}4}$ on four lines that are associated with respective awards of one hundred credits, twenty credits, five credits, and five credits, for a total award of one hundred and third credits. Thus, if the groups of winning symbols are highlighted in order of smallest associated award to largest associated award, the second group of winning symbols 120$a_2$ would be highlighted first, followed by the first group of winning symbols 120$a_1$.

The above implementation of the present concepts describes the win stack area 160 as sequentially displaying the representations 162*a-e* of the winning symbols on each of the lines. Alternatively or additionally, the win stack area 160 can sequentially display representations of the first stage of highlighting (e.g., all winning symbols) and/or representations of the second stage of highlighting (e.g., the groups of winning symbols).

The above implementation of the present concepts describes the win stack area 160 as sequentially displaying the representations 162*a-e* of the winning symbols on each of the lines and the associated award values 164*a-e*. Alternatively or additionally, the win stack area 160 can display representations of one or more previous winning outcomes of the wagering game in a searchable and/or manipulatable manner. For example, in such alternative implementations, the player can, for example, via a touch screen interface, visually move windows including representations of previous winning outcomes around the win stack area 160 to view representations of other previous winning outcomes. If the player selects a representation of a previous winning outcome, the player can drill down into representations of the groups of winning symbols and/or the winning symbols on each of the winning lines associated with the selected representation of the previous winning outcome, thereby viewing representations of the groups of winning symbols and winning symbols on the lines. The associated award of credits can also be displayed adjacent to any selected/viewed winning outcome, group, or line.

In some implementations, the player can opt to replay the previous play of the wagering game by selecting the representation of the previous winning outcome. While the credits previously achieved are not awarded again, the player can relive the excitement associated with the previous winning outcome and/or show other players or friends the winning outcome.

Further, in some implementations, only certain ones of the previous winning outcomes are stored as searchable in the win stack area 160. For example, only winning outcomes resulting in the awarding of one hundred or more credits are stored in the searchable manner.

Further, in some implementations, windows including representations of previous winning symbols on one or more lines are stored and/or viewable in the win stack area 160. The winning symbols on the lines can be sorted in three separate areas of the win stack area 160. For example, a first area of the win stack area can visually store all representations of the three-of-a-kind arrangements of winning symbols, a second area of the win stack area can visually store all representations of the four-of-a-kind arrangements of winning symbols, and a third area of the win stack area can visually store all representations of the five-of-a-kind arrangements of winning symbols. The representations of the previous winning symbols on the one or more lines can be stored only for the current game session or for other previous plays of the wagering game.

The representations of the previous winning outcomes, groups, and/or winning symbols on lines can be stored on a memory device coupled to the gaming terminal 10, a player's gaming or tracking card, or on memory in the gaming terminal 10.

In some implementations of the disclosed concepts, during the first, second, or third stage of highlighting, a player can select, via for example a touch screen interface, one of the symbols in the array of symbol positions 110 to view all winning symbols on all winning lines, if any, associated therewith by highlighting such winning symbols on such winning lines. For example, referring to FIG. 4, in such an implementation, if a player selects the symbol 120 associated with the first symbol position 112$_1$, zero winning symbols on zero lines would be highlighted as the symbol 120 associated with the first symbol position 112$_1$ is not associated with or a part of any winning line. However, if a player selects the symbol 120 associated with the second symbol position 112$_2$, winning symbols on one winning line (e.g., the winning symbols 120$a_{1,1}$ on the first line of the first group of winning symbols 1200 would be highlighted as the symbol 120 associated with the second symbol position 112$_2$ is associated with winning symbols on at least one winning line.

Each of the above concepts and obvious variations thereof is contemplated as falling within the spirit and scope of the claimed invention, which is set forth in the following claims.

What is claimed is:

1. A method of operating a gaming system, the gaming system including one or more controllers and a gaming machine, the gaming machine primarily used for playing a casino wagering game, the gaming machine including a display device and one or more electronic input devices, the method comprising:

detecting, via at least one of the one or more electronic input devices, a physical item associated with a monetary value that establishes a credit balance;

initiating the casino wagering game in response to an input indicative of a wager covered by the credit balance;

in response to the initiating, displaying, on the display device of the gaming machine, an outcome of the casino wagering game via a plurality of symbol-bearing reels; and in response to the outcome displayed on the display device of the gaming machine being a winning outcome formed by winning symbols on a plurality of lines:

(i) in response to the winning outcome being indicated by a first symbol group formed only by the same first symbol and a second symbol group formed only by the same second symbol that is different from the first symbol, visually highlighting in a sequential fashion one at a time, on the display device of the gaming machine, each of the first symbol group and the second symbol group; and (ii) after the visually highlighting the first symbol group and the second symbol group, visually highlighting in a sequential fashion one line at a time, on the display device of the gaming machine, the winning symbols or symbol positions or a representation of the winning symbols or symbol positions on each of the plurality of lines; and receiving, via at least one of the one or more electronic input devices, a collect input that initiates a payout from the credit balance.

2. The method of claim 1, further comprising, prior to the visually highlighting in the sequential fashion one at a time each of the first symbol group and the second symbol group, visually highlighting the first symbol group and the second symbol group together at the same time.

3. The method of claim 1, wherein the representation is displayed in a win stack area adjacent to the outcome.

4. A method of operating a gaming system, the gaming system including one or more controllers and a gaming machine, the gaming machine primarily used for playing a casino wagering game, the gaming machine including a display device and one or more electronic input devices, the method comprising:

detecting, via at least one of the one or more electronic input devices, a physical item associated with a monetary value that establishes a credit balance;

initiating the casino wagering game in response to an input indicative of a wager covered by the credit balance;

in response to the initiating, displaying, on the display device of the gaming machine, an outcome of the casino wagering game via an array of symbol positions, each of the symbol positions being associated with one of a plurality of symbols; and in response to the outcome displayed on the display device of the gaming machine being a winning outcome formed by winning symbols and non-winning symbols:

(i) determining if the winning outcome includes two or more groups of winning symbols, a first of the groups comprising only all of a first symbol that are winning symbols and a second of the groups comprising only all of a second symbol that are winning symbols, the first symbol being different than the second symbol;

(ii) in response to determining that the winning outcome includes two or more groups of winning symbols:

a. visually highlighting in a sequential fashion one at a time, on the display device of the gaming machine, each of the two or more groups of winning symbols; and b. in response to determining that one of the two or more groups includes winning symbols on two or more lines and after the visually highlighting each of the two or more groups of winning symbols, visually highlighting in a sequential fashion one at a time, on the display device of the gaming machine, the winning symbols on each of the two or more lines; and receiving, via at least one of the one or more electronic input devices, a collect input that initiates a payout from the credit balance.

5. The method of claim 4, wherein the winning symbols on the two or more lines only include the symbols that cause the lines to be winning lines.

6. The method of claim 4, wherein the visually highlighting each of the two or more groups of winning symbols includes (i) raising all of the winning symbols in a first one of the groups from a first virtual plane to a second virtual plane such that the winning symbols in the first one of the groups visually pop-out of the display device of the gaming machine and (ii) raising all of the winning symbols in a second one of the groups from the first virtual plane to the second virtual plane such that the winning symbols in the second one of the groups visually pop-out of the display device of the gaming machine.

7. The method of claim 6, wherein the raising all of the winning symbols in the first one of the groups includes virtually translating the winning symbols in the first one of the groups along a Z-axis and the raising all of the winning symbols in the second one of the groups includes virtually translating the winning symbols in the second one of the groups along the Z-axis, wherein the first and the second virtual planes are defined by X and Y axes.

8. The method of claim 4, further comprising visually highlighting, on the display device of the gaming machine, all of the winning symbols.

9. The method of claim 8, wherein the visually highlighting all of the winning symbols is a first stage visual display, the visually highlighting in a sequential fashion the groups of winning symbols is a second stage visual display, and the visually highlighting in a sequential fashion the winning symbols on each of the two or more lines is a third stage visual display, the method further comprising:

prior to visually displaying the third stage visual display, repeating in an alternating manner the first stage and the second stage visual displays during a visual display of a credit award bang-up; and commencing the third stage visual display upon the conclusion of the visual display of the credit award bang-up, the length of the visual display of the credit award bang-up being based on the award.

10. The method of claim 4, wherein the winning symbols on each of the lines is a combination of symbols contained within a paytable having an award value associated therewith.

11. A method of operating a gaming system, the gaming system including one or more controllers and a gaming machine, the gaming machine primarily used for playing a casino wagering game, the gaming machine including a display device and one or more electronic input devices, the method comprising:

detecting, via at least one of the one or more electronic input devices, a physical item associated with a monetary value that establishes a credit balance;

initiating the casino wagering game in response to an input indicative of a wager covered by the credit balance;

in response to the initiating, displaying, on the display device of the gaming machine, an outcome of the casino wagering game via an array of symbol positions, each of the symbol positions being associated with one of a plurality of symbols; and in response to the outcome displayed on the display device of the gaming machine being a winning outcome formed by winning symbols and non-winning symbols:

(i) determining if the winning outcome includes two or more groups of winning symbols;

(ii) in response to determining that the winning outcome includes two or more groups of winning symbols:

a. visually highlighting in a sequential fashion one at a time, on the display device of the gaming machine, each of the two or more groups of winning symbols by raising all of the winning symbols in each of the two or more groups from a first virtual plane to a second virtual plane such that the winning symbols visually pop-out of the display device of the gaming machine;

b. determining if each of the two or more groups includes winning symbols on two or more lines;

c. in response to determining that one of the two or more groups includes winning symbols on two or more lines, visually highlighting in a sequential fashion one at a time, on the display device of the gaming machine, the winning symbols on each of the two or more lines;

d. prior to the visually highlighting the winning symbols on each of the two or more lines, visually scaling back the array of symbol positions, thereby visually exposing a win stack area that is displayed on the display device of the gaming machine adjacent to the array of symbol positions; and e. sequentially displaying, on the display device of the gaming machine, in the win stack area a representation of the winning symbols on each of the lines and an award associated therewith; and receiving, via at least one of the one or more electronic input devices, a collect input that initiates a payout from the credit balance.

12. The method of claim 11, wherein the sequentially displaying of the representations in the win stack area occurs simultaneously with the visually highlighting of the winning symbols on each of the two or more lines.

13. The method of claim 11, wherein the sequentially displaying of the representations in the win stack area further comprises sequentially displaying a representation of each of the groups of winning symbols.

14. A method of operating a gaming system, the gaming system including one or more controllers and a gaming machine, the gaming machine primarily used for playing a casino wagering game, the gaming machine including a display device and one or more electronic input devices, the method comprising:

detecting, via at least one of the one or more electronic input devices, a physical item associated with a monetary value that establishes a credit balance;

initiating the casino wagering game in response to an input indicative of a wager covered by the credit balance;

in response to the initiating, displaying, on the display device of the gaming machine, an outcome of the casino wagering game via a plurality of symbol-bearing reels; and in response to the outcome displayed on the display device of the gaming machine being a winning outcome formed by winning symbols:

(i) in response to the winning outcome being indicated by a first symbol group formed only by the same first symbol and a second symbol group formed only by the same second symbol that is different from the first symbol, visually highlighting in a sequential fashion one at a time, on the display device of the gaming machine, each of the first symbol group and the second symbol group;

(ii) after the visually highlighting the first symbol group and the second symbol group and in response to the first symbols of the first symbol group being on two or more lines, visually highlighting in a sequential fashion one at a time, on the display device of the gaming machine, the first symbols on each of the two or more lines; and receiving, via at least one of the one or more electronic input devices, a collect input that initiates a payout from the credit balance.

15. The method of claim 14, wherein the first symbol group only includes all of the first symbols included in the outcome that are winning symbols and the second symbol group only includes all of the second symbols included in the outcome that are winning symbols.

16. The method of claim 14, wherein the second symbol group includes winning symbols on a third line, wherein the winning symbols on each of the two or more lines only includes the first symbols that cause the two or more lines to be winning lines, and wherein the winning symbols on the third line only includes the second symbols that cause the third line to be a winning line.

17. The method of claim 16, wherein the winning symbols on each of the lines are associated with separate and distinct awards.

18. The method of claim 17, further comprising, after the visually highlighting the first symbols on each of the two or more lines, visually highlighting, on the display device of the gaming machine, the second symbols on the third line.

19. The method of claim 18, further comprising, after the visually highlighting the first symbol group and the second symbol group and prior to the visually highlighting the first symbols on each of the two or more lines, visually scaling back the plurality of symbol-bearing reels, thereby visually exposing a win stack area that is displayed on the display device of the gaming machine adjacent to the plurality of symbol-bearing reels.

20. The method of claim 19, further comprising sequentially displaying, on the display device of the gaming machine, in the win stack area a representation of the winning symbols on each of the lines simultaneously with the visually highlighting of the winning symbols on each of the lines.

21. The method of claim 16, further comprising, prior to the visually highlighting the first symbol group and the second symbol group, visually highlighting, on the display device of the gaming machine, all of the winning symbols.

22. The method of claim 16, wherein the winning symbols on a first line of the two or more lines include three of the first symbol, thereby being a three-of-a-kind arrangement of winning symbols, and the winning symbols on a second line of the two or more lines include four of the first symbol, thereby being a four-of-a-kind arrangement of winning symbols, the four-of-a-kind arrangement of winning symbols being associated with a first award that is larger than a second award associated with the three-of-a-kind arrangement of winning symbols.

23. The method of claim 16, further comprising:

storing, in one or more memory devices, winning outcomes achieved in a predetermined number of prior plays of the casino wagering game; and visually displaying, on the display device of the gaming machine, a win stack area adjacent to the plurality of symbol-bearing reels, the win stack area including visual representations of each winning outcome stored in the one or more memory devices, the visual representations of the winning outcomes being visually displayed in the win stack area in an organized fashion such that a player of the casino wagering game can interact with the win stack area and selectively view (i) all winning symbols for each winning outcome, (ii) each group of winning symbols for each winning outcome, and (iii) winning symbols on each line for each winning outcome.

24. The method of claim 14, further comprising visually displaying, on the display device of the gaming machine, a win stack area adjacent to the plurality of symbol-bearing reels, the win stack area including a sequential display of a representation of the two or more lines simultaneously with the visually highlighting in the sequential fashion of the first symbols on each of the two or more lines.

25. The method of claim 14, wherein the visually highlighting each of the first symbol group and the second symbol group includes (i) raising all of the winning symbols in the first symbol group from a first virtual plane to a second virtual plane such that the winning symbols in the first symbol group visually pop-out of the display device of the gaming machine and (ii) raising all of the winning symbols in the second symbol group from the first virtual plane to the second virtual plane such that the winning symbols in the second symbol group visually pop-out of the display device of the gaming machine.

26. A gaming system comprising:

a gaming machine primarily used for playing a casino wagering game, the gaming machine including a display device and one or more electronic input devices; and one or more controllers configured to cause the gaming system to:

detect, via at least one of the one or more electronic input devices, a physical item associated with a monetary value that establishes a credit balance;

initiate the casino wagering game in response to an input indicative of a wager covered by the credit balance;

in response to the initiation of the casino wagering game, display, on the display device of the gaming machine, an outcome of the casino wagering game via a plurality of symbol-bearing reels;

in response to the outcome displayed on the display device of the gaming machine being a winning outcome formed by winning symbols:

(i) in response to the winning outcome being indicated by a first symbol group formed only by the same first symbol and a second symbol group formed only by the same second symbol that is different from the first symbol, visually highlight in a sequential fashion one at a time, on the display device of the gaming machine, each of the first symbol group and the second symbol group;

(ii) after the visually highlighting of the first symbol group and the second symbol group and in response to the first symbols of the first symbol group being on two or more lines, visually highlight in a sequential fashion one at a time, on the display device of the gaming machine, the first symbols on each of the two or more lines; and receive, via at least one of the one or more electronic input devices, a collect input that initiates a payout from the credit balance.

27. The gaming system of claim 26, wherein the winning symbols on each of the two or more lines include all of the first symbols that cause the respective line to be a winning line.

28. The gaming system of claim 26, wherein the gaming system is further caused to visually display, on the display device of the gaming machine or another display device, a win stack area, the win stack area sequentially displaying a representation of the winning symbols on each of the two or more lines simultaneously with the visually highlighting in the sequential fashion of the first symbols on each of the two or more lines.

29. The gaming system of claim 28, further comprising a button panel including the other display device that visually displays the win stack area.

30. The gaming system of claim 26, wherein the gaming system is further caused to visually display, on the display device of the gaming machine, a win stack area, the win stack area including visual representations of each winning outcome achieved in a predetermined number of prior plays of the casino wagering game.

31. The gaming system of claim 30, wherein the winning outcomes achieved in the predetermined number of prior plays of the casino wagering game are stored in one or more memory devices of the gaming system and displayed in the win stack area in an organized fashion such that a player of the gaming system can interact with the win stack area and selectively view (i) all winning symbols for each winning outcome, (ii) each group of winning symbols for each winning outcome, and (iii) winning symbols on each of the lines for each winning outcome.

32. The gaming system of claim 26, wherein the first symbol group only includes all of the first symbols included in the outcome that are winning symbols and the second symbol group only includes all of the second symbols included in the outcome that are winning symbols.

33. The gaming system of claim 26, wherein the visually highlighting each of the first symbol group and the second symbol group includes (i) raising all of the winning symbols in the first symbol group from a first virtual plane to a second virtual plane such that the winning symbols in the first symbol group visually pop-out of the display device of the gaming machine and (ii) raising all of the winning symbols in the second symbol group from the first virtual plane to the second virtual plane such that the winning symbols in the second symbol group visually pop-out of the display device of the gaming machine.

34. A gaming system, comprising:

a gaming machine primarily used for playing a wagering game, the gaming machine including a display device and one or more electronic input devices; and one or more controllers configured to cause the gaming system to:

detect, via at least one of the one or more electronic input devices, a physical item associated with a monetary value that establishes a credit balance;

initiate the casino wagering game in response to an input indicative of a wager covered by the credit balance;

in response to the initiation of the casino wagering game, display, on the display device of the gaming machine, a plurality of symbol-bearing reels;

visually spin the reels and stop the reels such that an outcome of the casino wagering game is indicated by the reels; and in response to the outcome being a winning outcome formed by winning symbols and non-winning symbols, (i) on the display device of the gaming machine, visually highlight in a sequentially fashion each group of winning symbols, at least one of the groups including winning symbols on two or more lines, and (ii) on the display device of the gaming machine, visually highlight in the sequential fashion the winning symbols on each of the lines, wherein prior to the gaming system being caused to visually highlight in the sequential fashion the winning symbols on each of the lines, the gaming system is further caused to visually shrink the plurality of symbol-bearing reels, thereby visually exposing a win stack area displayed on the display device of the gaming machine adjacent to the plurality of symbol-bearing reels, the gaming system being further caused to sequentially display, on the display device of the gaming machine, in the win stack area a representation of the winning symbols on each of the lines simultaneously with the visually highlighting of the winning symbols on each of the lines.

* * * * *